US007190357B2

(12) United States Patent
Ohta et al.

(10) Patent No.: US 7,190,357 B2
(45) Date of Patent: Mar. 13, 2007

(54) SIGNAL LINE DRIVE CIRCUIT, IMAGE DISPLAY DEVICE, AND PORTABLE APPARATUS

(75) Inventors: Takashige Ohta, Yamatokoriyama (JP); Toshihiro Yanagi, Taki-gun (JP); Kouji Kumada, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 55 days.

(21) Appl. No.: 09/925,909

(22) Filed: Aug. 9, 2001

(65) Prior Publication Data

US 2002/0036624 A1 Mar. 28, 2002

(30) Foreign Application Priority Data

Aug. 10, 2000 (JP) ..... 2000-242123
Jul. 3, 2001 (JP) ..... 2001-202727

(51) Int. Cl.
*G09G 5/00* (2006.01)
*G09G 3/36* (2006.01)

(52) U.S. Cl. ..... 345/204; 89/100

(58) Field of Classification Search ..... 345/605, 345/98, 204, 89, 100, 690; 245/211
See application file for complete search history.

(56) References Cited

U.S. PATENT DOCUMENTS 5,414,443 A * 5/1995 Kanatani et al. ..... 345/95
5,477,234 A * 12/1995 Suzuki et al. ..... 345/95
5,570,105 A * 10/1996 Koyama ..... 345/98
6,107,981 A * 8/2000 Fujita ..... 345/95
6,151,005 A * 11/2000 Takita et al. ..... 345/89
6,225,992 B1 * 5/2001 Hsu et al. ..... 345/211
6,278,426 B1 * 8/2001 Akiyama ..... 345/87
6,426,670 B1 * 7/2002 Tanaka ..... 327/541
6,549,196 B1 * 4/2003 Taguchi et al. ..... 345/210
6,580,359 B1 * 6/2003 Tam ..... 340/14.1
6,677,923 B2 * 1/2004 Kajihara et al. ..... 345/89
6,762,737 B2 * 7/2004 Kajihara et al. ..... 345/89

FOREIGN PATENT DOCUMENTS

| | | |
|---|---|---|
| EP | 0 487 137 A1 | 5/1992 |
| EP | 1 014 334 A2 | 6/2000 |
| JP | 03-015313 | 1/1991 |
| JP | 04-294325 | 10/1992 |
| JP | 5-61794 | 8/1993 |
| JP | 5-265419 | 10/1993 |
| JP | 05-313612 | 11/1993 |

(Continued)

*Primary Examiner*—Jimmy H. Nguyen
(74) *Attorney, Agent, or Firm*—David G. Conlin; David A. Tucker; Edwards Angell Palmer & Dodge LLP

(57) ABSTRACT

The signal line drive circuit is provided with: a reference voltage chooser circuit for choosing one of incoming voltages in accordance with tones represented by an image signal to output the chosen voltage as a signal line drive signal; and a reference voltage line for directly transmitting first reference voltages VB1 (inclusive of a maximum voltage value VB1max and a minimum voltage value VB1min) supplied by an external reference power supply circuit to the reference voltage chooser circuit. The arrangement eliminates the need to provide a buffer circuit to a reference voltage line over which the first reference voltage is directly transmitted, thereby reducing that electric current which would otherwise flow through the buffer circuit.

22 Claims, 4 Drawing Sheets

FOREIGN PATENT DOCUMENTS

| | | |
|---|---|---|
| JP | 06-348236 | 12/1994 |
| JP | 09-127918 | 5/1997 |
| JP | 10-326084 | 12/1998 |
| JP | 3007745 | 11/1999 |
| JP | 2000-137467 | 5/2000 |
| JP | 3082221 | 6/2000 |
| KR | 1994-0009730 | 5/1994 |

* cited by examiner

PRIOR ART FIG. 4
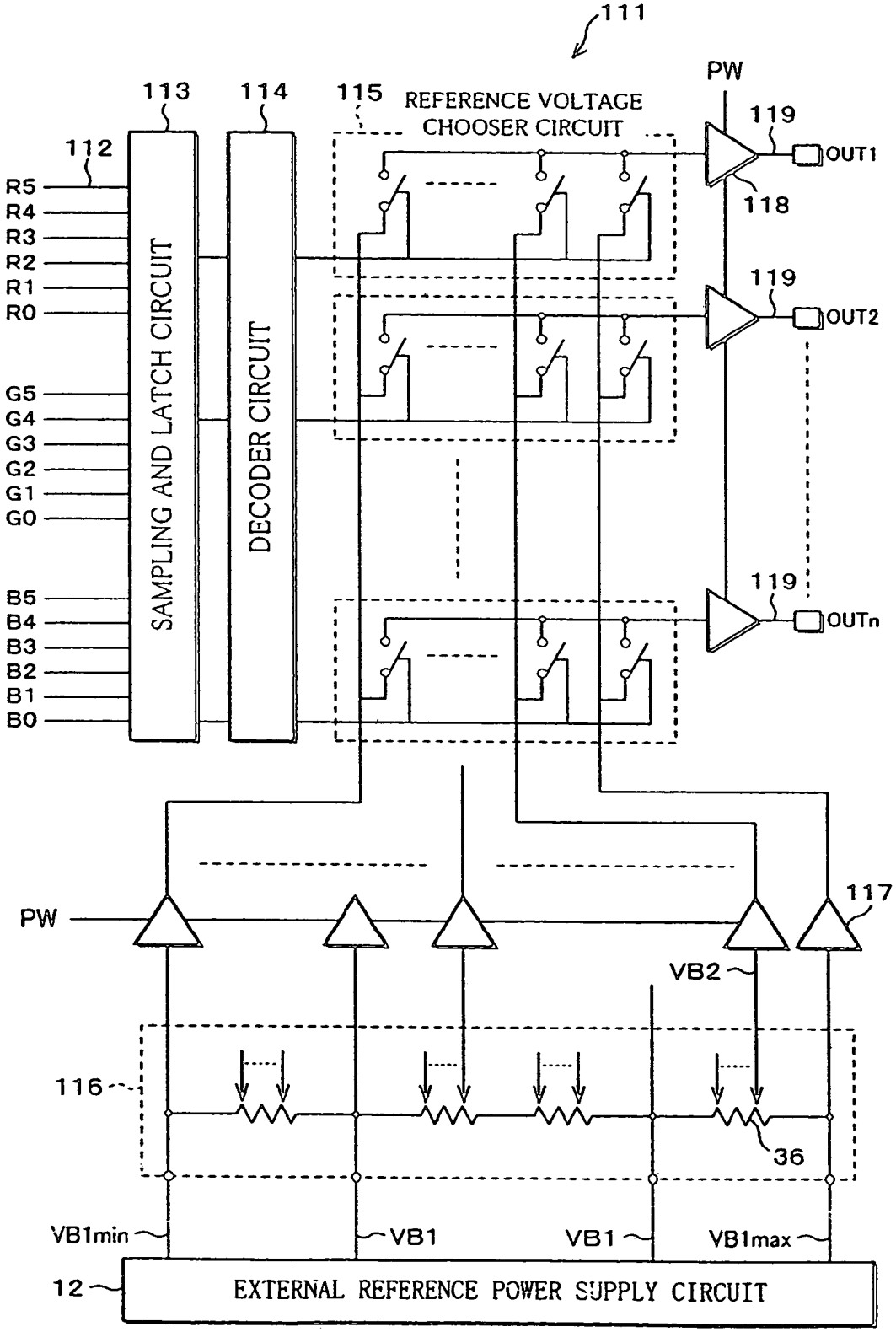

SIGNAL LINE DRIVE CIRCUIT, IMAGE DISPLAY DEVICE, AND PORTABLE APPARATUS

FIELD OF THE INVENTION

The present invention relates to signal line drive circuits in image display devices for sampling image signals and supplying tone-specific signal line drive signals to signal lines, image display devices incorporating the signal line drive circuits, and portable apparatuses incorporating the image display devices.

BACKGROUND OF THE INVENTION

Liquid crystal displays are in wide use as display sections in, for example, portable apparatuses which are required to be small and power-saving. FIG. 3 shows, as an example, an arrangement of such a liquid crystal display.

Referring to FIG. 3, the active matrix liquid crystal display 101 has pixel electrodes 16 arranged in a matrix form. Each pixel electrode 16 is connected to its own signal line 18 and scan line 19 via a TFT (thin film transistor) 17 and other active elements. The signal lines 18 and the scan lines 19 are disposed on a first transparent substrate 20. Opposite to the first transparent substrate 20 is disposed a second transparent substrate (not shown) with opposite electrodes (not shown). Liquid crystal (not shown) is sandwiched and sealed between the first transparent substrate 20 and the second transparent substrate.

The active matrix liquid crystal display 101 receives image signals (R0, etc.) from an image signal supply circuit 3. After being adjusted in terms of timing by, for example, a latch circuit 13, the image signals are fed to the signal line drive circuit 111 which in turn feeds signal line drive signals to drive the signal lines 18. A scan line drive circuit 15 feeds scan signals to the scan lines 19 in synchronism with the image signals for vertical scanning of the scan lines 19.

Configured this way, the active matrix liquid crystal display 101 boasts superior image quality and is used in a portable apparatus where high image quality is essential. Demand is strong for portable apparatuses which display with further improved quality and at the same time offer more running hours between battery recharging. To this end, the image display device in a portable apparatus needs to be low in power consumption. The active matrix liquid crystal display 101 is a liquid crystal display and inherently consumes relatively small amounts of electric power; it is, however, required to improve on the feature to respond to the market demand.

Conventionally, the large majority of active matrix liquid crystal displays 101 has been transmissive. However, reflective and reflective/transmissive types are increasingly popular in new portable apparatuses, especially very compact apparatuses like portable telephones. This is made possible because of the development of reflective and reflective/transmissive active matrix liquid crystal displays with faithful color reproduction capability. Another reason is that these types of active matrix liquid crystal displays either do not need a backlight at all as transmissive types or uses only a supplementary backlight, saving greatly on the electric power supplied to the backlight.

The signal line drive circuit 111 feeding signal line drive signals to the signal lines 18 ranks right after the backlight in the decreasing order of power consumption. Power saving in the signal line drive circuit 111 is therefore particularly important in the reflective or reflective/transmissive active matrix liquid crystal display 101.

Japanese Examined Patent Publication No. 3007745 (published on Feb. 7, 2000) discloses an invention with an objective to reduce the power consumption in the signal line drive circuit 111. The invention adjusts the position of a buffer circuit in the signal line drive circuit 111. The following will describe the arrangement of the signal line drive circuit 111 in reference to FIG. 4 showing the circuit.

112 represents input terminals where the active matrix liquid crystal display 101 receives image signals. In FIG. 4, the image signals are divided into red (R), green (G), and blue (B), 6 bits for each color, and denoted by R0–R5, G0–G5, and B0–B5. 113 represents a sampling and latch circuit that samples and latches the image signals to produce output signals controlling the decoder circuit 114 in the succeeding stage. The decoder circuit 114 converts the image signals to signals controlling reference voltage chooser circuits 115 in the succeeding stage using a decoder table on the basis of the tones represented by the image signals sampled by the sampling and latch circuit 113. The reference voltage chooser circuit 115 chooses one of incoming reference voltages according to the output of the decoder circuit 114.

116 is a voltage divider circuit in which ladder resistors 36, etc. and divides a first reference voltage VB1 fed from an external reference power supply circuit 12. The reference voltages produced by the voltage divider circuit 116 by voltage division will be referred to as the second reference voltages VB2. The first reference voltage VB1 and the second reference voltages VB2 are fed via buffer circuits 117 each having a high input impedance and a low output impedance to each reference voltage chooser circuit 115 where one of the reference voltages is chosen. The output of each reference voltage chooser circuit 115 is transmitted via an output buffer circuit 118 to an output terminal 119 of the signal line drive circuit 111. Arranged in this manner, the signal line drive circuit 111 can save the overall power consumption by reducing the current flow through the voltage divider circuit 116.

The signal line drive circuit 111 in conventional active matrix liquid crystal displays 101 however has reduced its power consumption only by reducing the current flow through some circuits in the signal line drive circuit 111. More tinkering is necessary to achieve sufficient power saving and hence extend running hours of the portable apparatus. Saving on power in the signal line drive circuit 111 contributes a lot to saving on power in the entire image display device. This is especially true with reflective and reflective/transmissive displays, since in these types of displays a highly power-consuming backlight is either unnecessary or used only for supplementary purposes.

Portable telephones, which have gained growing popularity in recent years and are certainly going to enjoy more in the foreseeable future, consume large amounts of power during communication, but little power during standby: the difference in power consumption is well more than 100 times. Accordingly, the required level of power saving varies greatly depending on the operating conditions of the device. Taking a typical portable telephone as an example, the overall power consumption is about 5 mW during standby and about 900 mW during communication. Accordingly, the required level of power saving varies greatly depending on the operating condition of the display in the portable telephone.

SUMMARY OF THE INVENTION

The present invention addresses these problems and has objectives to further reduce power consumption in the signal line drive circuit and at the same time to provide a signal line drive circuit, for use in a matrix-type display, which can reduce its power consumption to suitable levels in line with operating conditions, an image display device incorporating the signal line drive circuit, and a portable apparatus incorporating the image display device.

To achieve these objectives, a signal line drive circuit in accordance with the present invention is provided with a reference voltage chooser circuit for choosing one of incoming voltages in accordance with tones represented by an image signal to output the chosen voltage as a signal line drive signal and is characterized in that the signal line drive circuit includes a reference voltage line directly transmitting a first reference voltage supplied by an external reference voltage supply circuit to the reference voltage chooser circuit.

In the arrangement, the first reference voltage is partly directly supplied to the reference voltage chooser circuit and no buffer circuit is required for the reference voltage line transmitting the directly supplied part of the first reference voltage. As a result, the signal line drive circuit is smaller in area and can save on power by the amount equivalent to the eliminated current which in a conventional arrangement will occur in the buffer circuit.

An image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit for supplying signal line drive signals to the signal lines, the signal line drive circuit including a reference voltage chooser circuit for choosing a voltage derived from incoming first reference voltages in accordance with tones represented by an image signal to output the chosen voltage, and is characterized in that:

a second reference voltage produced by voltage division from at least two of the first reference voltages is supplied to the reference voltage chooser circuit via a buffer circuit having a high input impedance and a low output impedance; and the first reference voltages are directly supplied to the reference voltage chooser circuit in which a voltage is chosen from input voltages to output a signal line drive signal in accordance with the tones represented by the image signal.

In the arrangement, the first reference voltage is partly directly supplied to the reference voltage chooser circuit and no buffer circuit is required for the reference voltage line transmitting the directly supplied part of the first reference voltage. As a result, the signal line drive circuit is smaller in area and can save on power by the amount equivalent to the eliminated current which in a conventional arrangement will occur in the buffer circuit. Power saving can be thereby achieved with the image display device incorporating such a signal line drive circuit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 4 is a circuit diagram showing an arrangement of a signal line drive circuit incorporated in the image display device in FIG. 3.

DESCRIPTION OF THE EMBODIMENTS

[Embodiment 1]

Figure 1:
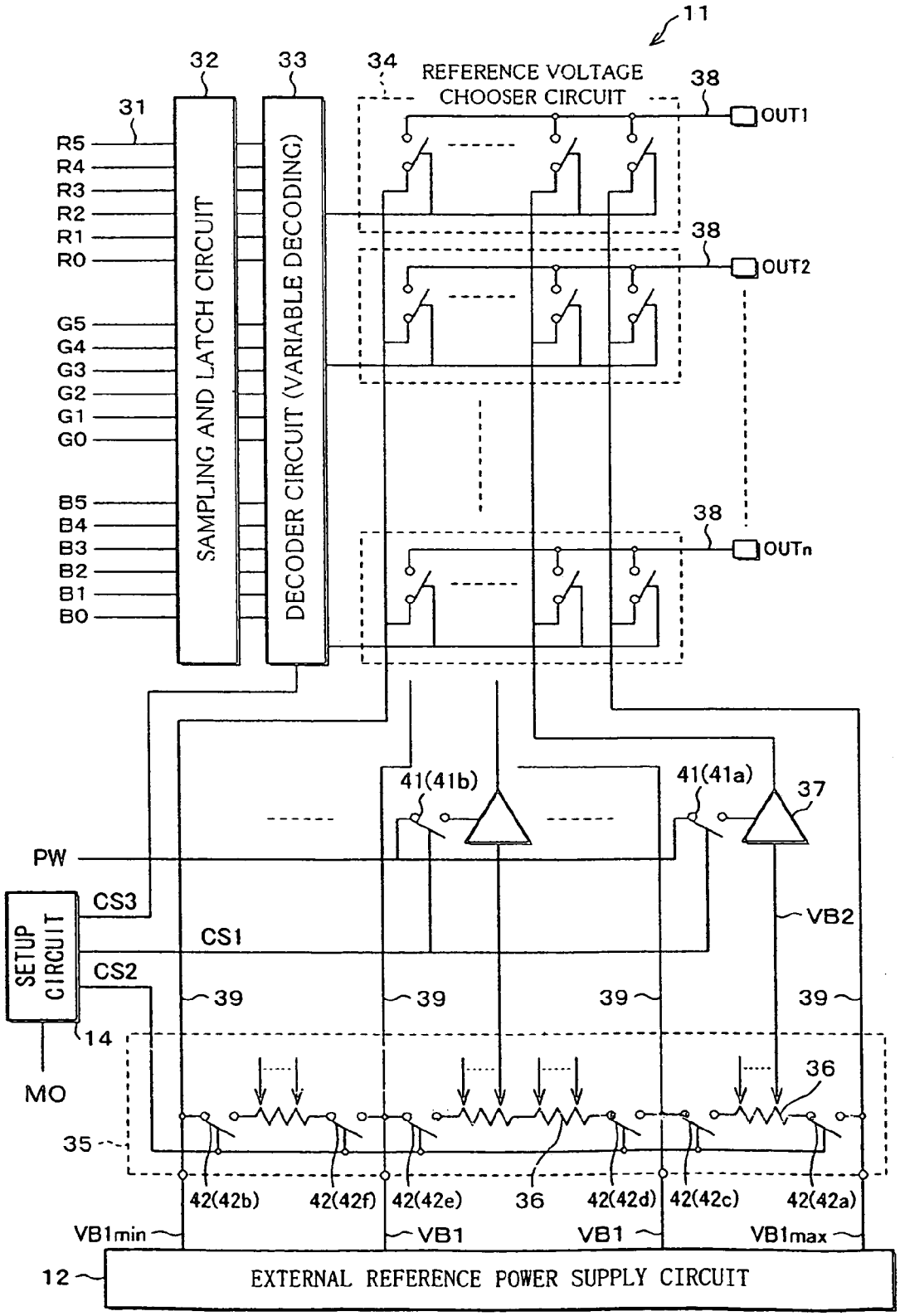
FIG. 1 is a circuit diagram showing an arrangement of a signal line drive circuit of an embodiment in accordance with the present invention.
Figure 2:
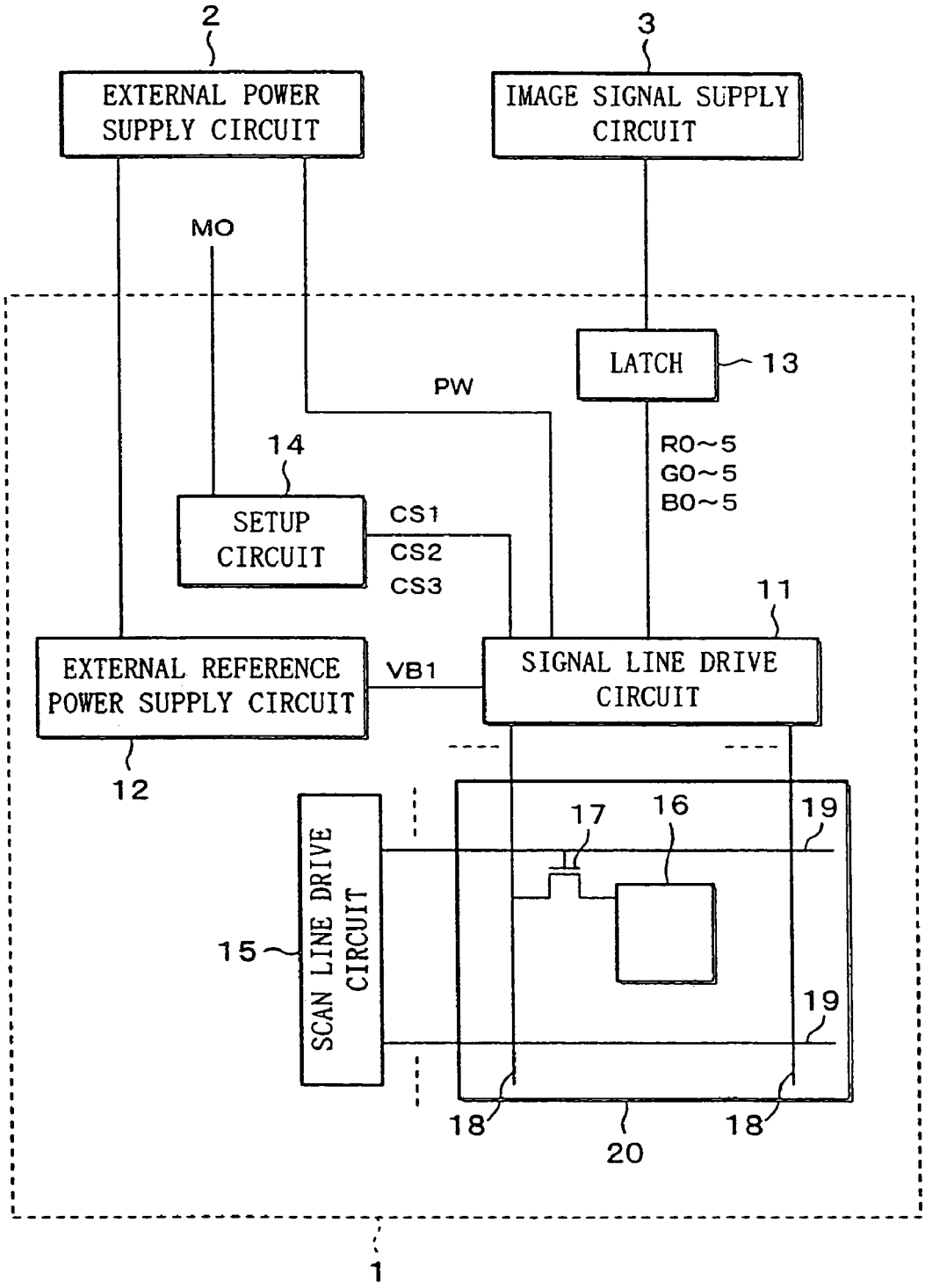
FIG. 2 is a block diagram showing an arrangement of an image display device incorporating the signal line drive circuit in FIG. 1.
Figure 3:
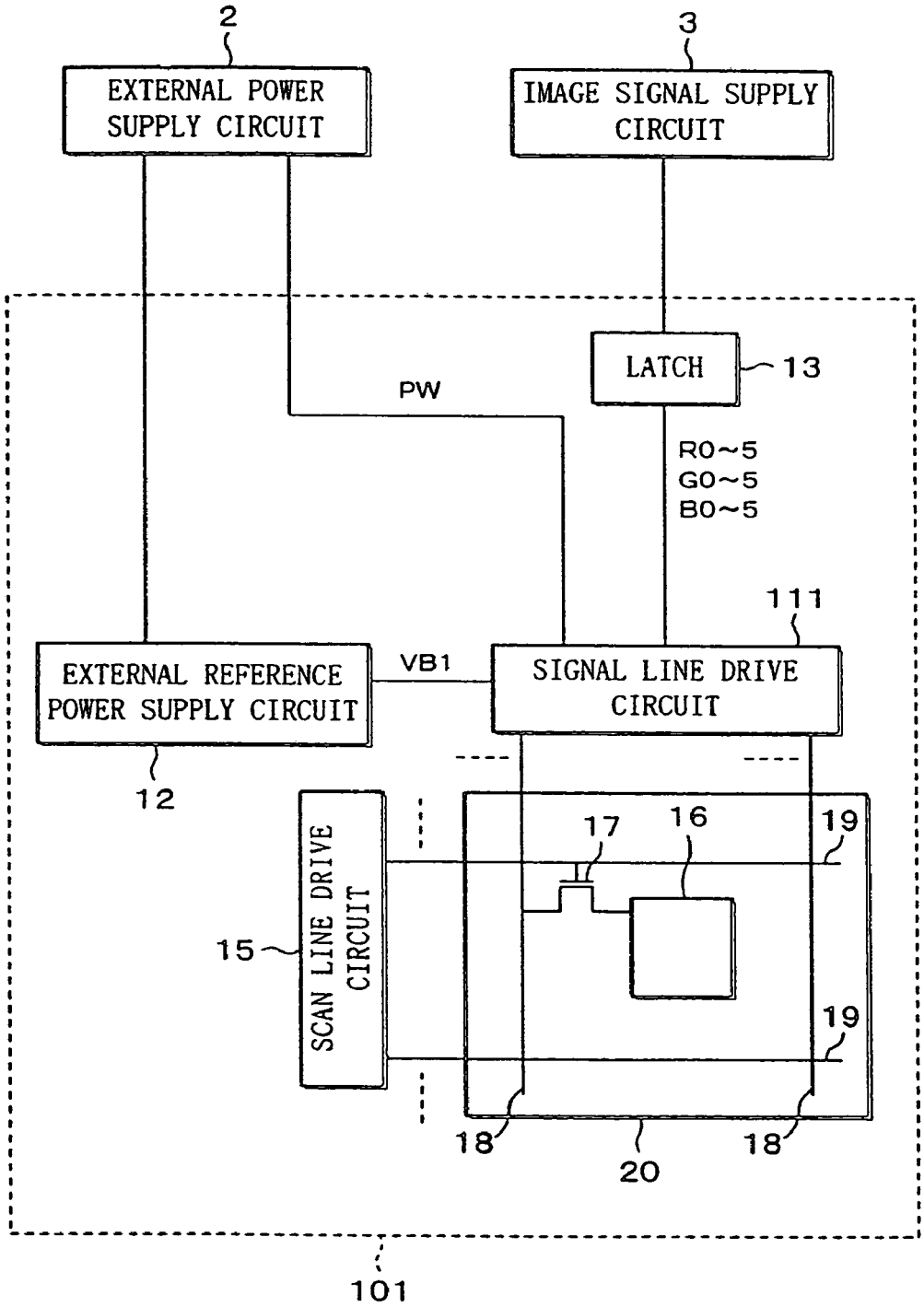
FIG. 3 PRIOR ART
FIG. 3 is a block diagram showing an arrangement of a conventional image display device.

Referring to FIGS. 1, 2, the following will describe an embodiment in accordance with the present invention. FIG. 1 is a circuit diagram of a signal line drive circuit 11, showing an embodiment in accordance with the present invention. FIG. 2 is a block diagram of an active matrix liquid crystal display 1 (an image display device of an embodiment in accordance with the present invention) incorporating the signal line drive circuit 11.

As shown in FIG. 2, the active matrix liquid crystal display 1 is connected to an external power supply circuit 2 and an image signal supply circuit 3. The external power supply circuit 2 supplies electric power to the liquid crystal display 1, supplying voltage to an external reference power supply circuit (reference voltage supply means), the signal line drive circuit 11, and other circuits. The image signal supply circuit 3 feeds image signals to the liquid crystal display 1. The image signals (R0–R5, etc.) are adjusted in terms of timings by the latch circuit 13 before transmitted to the signal line drive circuit 11. The signal line drive circuit 11 receives control signals CS1–CS3 from a setup circuit (control means) 14 as will be detailed later.

In the liquid crystal display 1, the signal line drive circuit 11 is connected to a plurality of signal lines 18, and the scan line drive circuit 15 is connected to a plurality of scan lines 19. There are also provided pixel electrodes 16 in a matrix form. Each pixel electrode 16 is connected to its own signal line 18 and scan line 19 via a TFT (thin film transistor) 17 and other active elements. The signal lines 18 and the scan lines 19 are disposed on a first transparent substrate 20. Opposite to the first transparent substrate 20 is disposed a second transparent substrate (not shown) with opposite electrodes (not shown). Liquid crystal (not shown) is sandwiched and sealed between the first transparent substrate 20 and the second transparent substrate.

The following will describe an arrangement of the signal line drive circuit 11 in FIG. 1. 31 represents input terminals where the liquid crystal display 1 receives image signals. In FIG. 1, the image signals are divided into red (R), green (G), and blue (B), 6 bits for each color, and denoted by R0, etc. 32 represents a sampling and latch circuit that samples and latches the image signals to produce output signals controlling a decoder circuit 33 in the succeeding stage. The decoder circuit 33 converts the image signals to signals controlling reference voltage chooser circuits 34 in the succeeding stage using a decoder table on the basis of the tones represented by the image signals sampled by the sampling and latch circuit 32. The reference voltage chooser circuit 34 chooses one of incoming reference voltages according to the output of the decoder circuit 33.

35 is a voltage divider circuit in which ladder resistors 36, etc. and divides a first reference voltage VB1 fed from an external reference power supply circuit 12. The reference voltages produced by the voltage divider circuit 35 dividing the first reference voltage VB1 will be referred to as the second reference voltages VB2. The second reference voltages VB2 are fed via buffer circuits 37 each having a high input impedance and a low output impedance to each reference voltage chooser circuits 34 where one of the reference voltages is chosen and coupled to an output terminal 38. The output terminal 38 are connected to the respective signal lines 18 in FIG. 2 to transmit the output signals driving the signal lines 18. In FIG. 1, the signal line drive circuit 11 is defined to have n outputs, where n is an integer larger than, or equal to, 1.

This arrangement is so far substantially identical to that of the signal line drive circuit 111 described in Background of the Invention in reference to FIG. 4. However, the signal line drive circuit 11 of the present embodiment includes the following additional arrangement to further reduce power consumption.

The power supply lines for the buffer circuits 37 are each equipped with a first switch 41 (41*a*, 41*b* . . . ). Each first switch 41 closes/opens the power supply line for the associated buffer circuit 37. The closure/opening of the first switches 41 is controlled by the first control signal CS1 supplied from the setup circuit 14. The buffer circuits 37 are disposed between the voltage divider circuit 35 and the reference voltage chooser circuits 34 to convert the second reference voltages VB2 generated by the ladder resistors 36 in the voltage divider circuit 35 in terms of impedance before supplying the second reference voltages VB2 to the reference voltage chooser circuit 34.

There are provided second switches 42 (42*a*, 42*b* . . . ) between the ladder resistors 36 and the power supply lines for the voltage divider circuits 35 (the lines to supply the first reference voltage VB1 to the voltage divider circuits 35). Each second switch 42 closes/opens the power supply line for the associated ladder resistors 36. The closure/opening of the second switches 42 is controlled by the second control signal CS2 supplied from the setup circuit 14.

If the first reference voltage VB1 is directly fed to the reference voltage chooser circuit 34 as a reference voltage without being changed in amplitude, the buffer circuit 37 is omitted, that is, at least one of the reference voltages fed to the reference voltage chooser circuit (tone chooser circuit) 34 is the first reference voltage VB1 (the first reference voltage VB1 is used as such). Hereinafter, this reference voltage will be referred to as a direct reference voltage.

The image signals, fed to the signal line drive circuit 11 for sampling in the sampling and latch circuit 32, are decoded in the decoder circuit 33 in the succeeding stage to produce signals controlling the reference voltage chooser circuits 34. The decoder circuit 33 can change the decoder table before actually using the decoder table for decoding. This function will be hereinafter referred to as variable decoding. The changing of the decoder table is controlled by the third control signal CS3 supplied from the setup circuit 14.

As in the foregoing, the setup circuit 14 supplies the first control signal CS1, the second control signal CS2, and the third control signal CS3. The setup circuit 14 switches the signal line drive circuit 11 between various drive modes in response to a setup signal MO. For example, the setup circuit 14 chooses one of the drive modes in response to an incoming CMOS-level setup signal and supplies the first control signal CS1, the second control signal CS2, and the third control signal CS3 to the signal line drive circuit 11 to switch the signal line drive circuit 11 to that drive mode. Each of these control signals is not necessarily transmitted through a single output line and may be transmitted through a number of output lines that is determined in view of the number of elements the control signal is supposed to control. Therefore, the control signals CS1, CS2, and CS3 may each be transmitted through two or more output lines.

The level of the setup signal MO is not necessarily equal to a CMOS level and may be equal to the TTL level. Alternatively, the level of the setup signal MO may be of difference input. The setup signal MO may be either parallel or serial; the latter case would require less signal lines. Further, the setup signal MO may be transmitted in a serial signal together with image signals, clocks (not shown), and other signals that are supplied to the liquid crystal display 1. The setup circuit 14 is provided external to the signal line drive circuit 11 in FIG. 2, but may be integrated into the signal line drive circuit 11.

The signal line drive circuit 11 here only needs to have at least one of the four elements, i.e., the first switches 41, the second switch 42, the direct reference voltage, and the variable decoding, and may thus integrate in itself, for example, two, three, or all of the four elements. One can choose as necessary which of the four elements be integrated into the signal line drive circuit 11, depending on the size (chip area) of the signal line drive circuit 11, the desired reduction in power consumption, the number of tones represented by the image signals, the drive modes of the image display device, and other factors. Now, the elements will be described one by one in terms of their functions.

The first switches 41 close/open the power supply lines for the buffer circuits 37 in the signal line drive circuit 11 to supply power only to those buffer circuits 37 that need to be activated. The external power supply circuit 2 applies a power supply voltage to the power supply lines via the power supply line PW in FIG. 2. In this arrangement, the power supply can be selectively cut off, and no voltage is supplied to those buffer circuits 37 that are not used because of reduced display bits. The signal line drive circuit 11 is therefore operable on a minimum amount of power, successfully saving on the power.

FIG. 1 shows, as an example, the first reference voltage VB1 of four different values (VB1max, VB1min, two intermediate values between VB1max and VB1min) is supplied to the signal line drive circuit 11 to produce a display of up to 64 tones. In this arrangement, if the image signal carries two bits or less (representing four tones or less) for example, since the first reference voltage of four different values is already supplied to the signal line drive circuit 11 from the external reference power supply circuit 12, opening all the first switches 41 (hence providing no power supply to the buffer circuits 37 at all) reduces the power consumption by the buffer circuits 37 without affecting the display.

Further, in the same arrangement, if the image signal carries 3 bits (representing 8 tones) for example, since the first reference voltage of four different values is already supplied from the external reference power supply circuit 12, the voltage divider circuit 35 needs to create four second reference voltages VB2 (corresponding to the remaining four tones) to fulfil the discrepancy; the first switches 41 are closed/opened so as to provide power supply to only four of the buffer circuits 37, cutting off the power supply to the remaining 56 buffer circuits 37. The buffer circuits 37 as a whole now consume only about 1/15 (=4/60) the power they consume if they are all activated. The effects of power saving are particularly evident with portable apparatuses which do not always have to produce a 64 tone (6 bit) display: a four tone display is sufficient to convey information by text.

On the other hand, closing all the first switches 41 produces a 64 tone (6 bit) display which is suitable for a graphics display. A 64 tone display consumes more power to produce than a 4 tone display, but is not used for an extended period of time, since the display is required only when the user needs to obtain a lot of information in a short period of time. Further, a 64 tone display requires not only the display section, but every component of the portable apparatus to work at full capacity; the power consumption of the display section accounts for a relatively small proportion of the power consumption of the whole portable apparatus. For these reasons, it is of great use that the signal line drive circuit 11, and hence the liquid crystal display 1, is capable of switching to power saving mode according to operating conditions.

Now, the second switches 42 will be described. In FIG. 1, the second switches 42 are interposed between the ladder resistors 36 constituting the voltage divider circuit 35 and the reference voltage lines (voltage supply lines) 39 transmitting the first reference voltage VB1 to the voltage divider circuit 35. Typically, the number of different values of the first reference voltage VB1 (the number of reference voltage lines 39) is less than the number of reference voltages necessary in the signal line drive circuit 11, because supplying all the reference voltages necessary in the signal line drive circuit 11 in the form of different values of the first reference voltage VB1 would require significantly more reference voltage lines 39 to transmit those reference voltages to the signal line drive circuit 11 and makes wiring difficult.

For example, in the case of a 64 tone (6 bit) display as in FIG. 1, the first reference voltage VB1 would require 64 reference voltage lines 39 for transmission, and the image display device (liquid crystal display 1) should be expanded in size to accommodate the wiring. This scenario is highly impractical with portable and other apparatuses that are required to further reduce the sizes. Accordingly, in the case that the image signals are 6 bit (representing 64 tones) as in FIG. 1, as many as four reference voltage lines 39 are provided for the transmission of the first reference voltage VB1, the voltage divider circuit 35 creates additional second reference voltages VB2 (corresponding to the remaining 60 tones) from the first reference voltage VB1 to fulfil the discrepancy.

In the present embodiment, the voltage divider circuit 35 is made of the ladder resistors 36 and relies on the ratios of the resistances of the ladder resistors 36 to produce the second reference voltages VB2. The voltage divider circuit 35 is basically capable of producing any necessary reference voltage from two voltages: namely, the maximum value, VB1max, and the minimum value, VB1min, of the first reference voltage VB1. However, the second reference voltages VB2 thus produced would not always have desired values, because fine adjustment of voltage levels would be impossible. To solve this problem, the voltage divider circuit 35 must be fed with three or more values as the first reference voltage VB1, that is, the maximum value VB1max, the minimum value VB1min, and at least one additional, intermediate value between the maximum and minimum values as the first reference voltage VB1.

In the actual arrangement in FIG. 1, the voltage divider circuit 35 is fed with four values as the first reference voltage VB1, that is, the maximum value VB1max, the minimum value VB1min, and two intermediate values as the first reference voltage VB1. This way, the resulting second reference voltage VB2 are given desired values with more ease. It is not the only possibility to provide two intermediate values of the first reference voltage VB1 as in FIG. 1; the number of intermediate values may be determined which is suitable to the apparatus. Under certain conditions, some apparatuses are operational with no intermediate values provided at all.

In the signal line drive circuit 11, the second switches 42 are interposed between the ladder resistors 36 constituting the voltage divider circuit 35 and the reference voltage lines 39 transmitting the first reference voltage VB1 as shown in FIG. 1. The second switches 42 make great contributions to power saving. Especially useful among them are the second switches 42 (42*a*) interposed between one of the ladder resistors 36 and the reference voltage line 39 transmitting the maximum voltage value VB1max and the second switches 42 (42*b*) interposed between one of the ladder resistors 36 and the reference voltage line 39 transmitting the minimum voltage value VB1min.

Specifically, a potential difference develops from different values of the first reference voltage VB1 (between different reference voltage lines 39), and a current results in the voltage divider circuit 35. The current is necessary only when the second reference voltages VB2 produced by the voltage divider circuit 35 serves to produce a display on a liquid crystal display. Controlling the passing/blocking of the current with the switching circuits 42*a*–42*f* reduces power consumption. Under these circumstances, since the maximum voltage value VB1max and the minimum voltage value VB1min are always supplied to the voltage divider circuit 35, the second switches 42*a*, 42*b* interposed between the associated ladder resistors 36 and the reference voltage lines 39 transmitting these voltages are particularly useful and important to power saving.

Suppose that the first reference voltage VB1 includes only two voltages, i.e., the maximum voltage value VB1max and the minimum voltage value VB1min, the second switches 42*a*, 42*b* are essential. Interposed between the associated ladder resistors 36 and the reference voltage lines 39 transmitting the first reference voltage VB1 of intermediate values, but not of the maximum voltage value VB1max and the minimum voltage value VB1min, those second switches 42*c*, 42*d*, 42*e*, 42*f* make contributions to power saving too.

The second control signal CS2 controls the closure/opening of the second switches 42 in accordance with the number of tones represented by the image signals. The second control signal CS2 may be such that it controls the second switches 42*a*, 42*b* individually to halt current from the reference voltage lines 39 transmitting the first reference voltage VB1 to the ladder resistors 36.

For example, in the arrangement in FIG. 1, if the image signals represent four tones, opening only the second switches 42*c*–42*f* also halts current to the ladder resistors 36. Under the same conditions, opening only the second switches 42*a*, 42*b* also halts, although insufficiently, current to the ladder resistors 36, and a partial current passes via the ladder resistors 36 between the reference voltage lines 39 transmitting the first reference voltage VB1 of intermediate values. However, no current passes via the ladder resistors 36 between the reference voltage line 39 transmitting the maximum voltage value VB1max and the reference voltage line 39 transmitting the minimum voltage value VB1min, and this makes a contribution to power saving. Of course, when the first reference voltage VB1 includes only two values, i.e., the maximum voltage value VB1max and the minimum voltage value VB1min, the second switches 42*a*, 42*b* are opened to reduce the current flow through the ladder resistors 36 and thus reduce the power consumption of the signal line drive circuit 11.

The following will describe a direct reference voltage arrangement whereby the first reference voltage VB1 is supplied as such to the reference voltage chooser circuits 34 without changing the level.

The first reference voltage VB1, supplied to the signal line drive circuit 11, is used as such as the reference voltages for the reference voltage chooser circuits 34 without changing the voltage value. The first reference voltage VB1 supplied from the external reference power supply circuit 4 with a low impedance changes little in the event of a variation in load and thus does not affect the image display device, even if the first reference voltage VB1 is directly fed to the reference voltage chooser circuits 34 without being channelled through the buffer circuits 37. The signal line drive circuit 11 with a direct reference voltage arrangement is smaller and less power-consuming than the signal line drive circuit 11 without such an arrangement, because the signal line drive circuit 11 with the arrangement has less buffer circuits 37 by the number of the values of the first reference voltage VB1 directly fed from the external reference power supply circuit 4 to the reference voltage chooser circuits 34.

Effecting a two tone display needs only the maximum voltage value VB1max and the minimum voltage value VB1min and no intermediate voltage values. Under these conditions, power consumption of the system as a whole can be reduced further by deactivating the buffer circuits 37 generating the second reference voltages VB2 from the intermediate voltage values supplied from the external reference power supply circuit 12. Further, if no intermediate voltage values are supplied to the external reference power supply circuit 12, the current passing through the ladder resistors 36 can be reduced for power saving even without the provision of the second switches 42*d*, 42*e*.

The following will describe the decoder circuit 33 with a variable decoding arrangement. The decoder circuit 33 has a function to convert the data (sampling data) collected by the sampling and latch circuit 32 in the preceding stage through sampling to a signal (control signal) controlling the reference voltage chooser in the succeeding stage. In these regards, the decoder circuit 33 is no different from the decoder circuit 114 in FIG. 4 with a conventional arrangement. The decoder circuit 33 of the present embodiment differs from decoder circuit 114 in that the decoder circuit 33 can change the conversion scheme of the sampling data to the control signal through the third control signal CS3. Specifically, the decoder circuit 33 includes an arrangement to switch between decoder tables for use in signal conversion through the third control signal CS3 (variable decoding).

Table 1 shows a decoder-table-based conversion when, as an example, the image signal carries 6 bits representing 64 tones (hereinafter, will be referred to 6 bit mode). The table shows, as an example, how the decoder circuit 33 controls the reference voltage chooser circuits 34 in the succeeding stage and changes the signal voltage outputs (hereinafter, will be referred to as signal line drive signals) from the signal line drive circuit 11 in response to the 64-tone data carried by 6-bit incoming image signals R0–R5.

The table shows four different values V0, V1, V2, V3 being supplied in this order as the first reference voltage VB1 to the signal line drive circuit 11. The reference voltage chooser circuits 34 produces, for outputs, the signal line drive signals from the first reference voltage VB1 and those voltages derived by voltage division from the first reference voltage VB1 (expressed by the products of fractions and the differences between voltages under the output voltage column of the table).

In FIG. 1, a single line is used to show the control signal line linking the decoder circuit 33 to the reference voltage chooser circuits 34. In actual practice, this does not necessarily mean that a single line transmits all the control signals; rather, an equal number of control signal lines and bits are provided to drive the associated switches in the reference voltage chooser circuits 34. This way, the image display device can produce 64 different signal line drive signals from the incoming image signals representing 64 tones to effect a 64-tone display.

TABLE 1

| TONE | INPUT | | | | | | OUTPUT |
|---|---|---|---|---|---|---|---|
| DATA | R5 | R4 | R3 | R2 | R1 | R0 | SIGNAL LINE DRIVE SIGNAL |
| 0 | 0 | 0 | 0 | 0 | 0 | 0 | V0 |
| 1 | 0 | 0 | 0 | 0 | 0 | 1 | V1 + (V0–V1) × 20/21 |
| 2 | 0 | 0 | 0 | 0 | 1 | 0 | V1 + (V0–V1) × 19/21 |
| 3 | 0 | 0 | 0 | 0 | 1 | 1 | V1 + (V0–V1) × 18/21 |
| 4 | 0 | 0 | 0 | 1 | 0 | 0 | V1 + (V0–V1) × 17/21 |
| 5 | 0 | 0 | 0 | 1 | 0 | 1 | V1 + (V0–V1) × 16/21 |
| 6 | 0 | 0 | 0 | 1 | 1 | 0 | V1 + (V0–V1) × 15/21 |
| 7 | 0 | 0 | 0 | 1 | 1 | 1 | V1 + (V0–V1) × 14/21 |
| 8 | 0 | 0 | 1 | 0 | 0 | 0 | V1 + (V0–V1) × 13/21 |
| 9 | 0 | 0 | 1 | 0 | 0 | 1 | V1 + (V0–V1) × 12/21 |
| 10 | 0 | 0 | 1 | 0 | 1 | 0 | V1 + (V0–V1) × 11/21 |
| 11 | 0 | 0 | 1 | 0 | 1 | 1 | V1 + (V0–V1) × 10/21 |
| 12 | 0 | 0 | 1 | 1 | 0 | 0 | V1 + (V0–V1) × 9/21 |
| 13 | 0 | 0 | 1 | 1 | 0 | 1 | V1 + (V0–V1) × 8/21 |
| 14 | 0 | 0 | 1 | 1 | 1 | 0 | V1 + (V0–V1) × 7/21 |
| 15 | 0 | 0 | 1 | 1 | 1 | 1 | V1 + (V0–V1) × 6/21 |
| 16 | 0 | 1 | 0 | 0 | 0 | 0 | V1 + (V0–V1) × 5/21 |
| 17 | 0 | 1 | 0 | 0 | 0 | 1 | V1 + (V0–V1) × 4/21 |
| 18 | 0 | 1 | 0 | 0 | 1 | 0 | V1 + (V0–V1) × 3/21 |
| 19 | 0 | 1 | 0 | 0 | 1 | 1 | V1 + (V0–V1) × 2/21 |
| 20 | 0 | 1 | 0 | 1 | 0 | 0 | V1 + (V0–V1) × 1/21 |
| 21 | 0 | 1 | 0 | 1 | 0 | 1 | V1 |
| 22 | 0 | 1 | 0 | 1 | 1 | 0 | V2 + (V1–V2) × 20/21 |
| 23 | 0 | 1 | 0 | 1 | 1 | 1 | V2 + (V1–V2) × 19/21 |
| 24 | 0 | 1 | 1 | 0 | 0 | 0 | V2 + (V1–V2) × 18/21 |
| 25 | 0 | 1 | 1 | 0 | 0 | 1 | V2 + (V1–V2) × 17/21 |
| 26 | 0 | 1 | 1 | 0 | 1 | 0 | V2 + (V1–V2) × 16/21 |
| 27 | 0 | 1 | 1 | 0 | 1 | 1 | V2 + (V1–V2) × 15/21 |
| 28 | 0 | 1 | 1 | 1 | 0 | 0 | V2 + (V1–V2) × 14/21 |
| 29 | 0 | 1 | 1 | 1 | 0 | 1 | V2 + (V1–V2) × 13/21 |
| 30 | 0 | 1 | 1 | 1 | 1 | 0 | V2 + (V1–V2) × 12/21 |
| 31 | 0 | 1 | 1 | 1 | 1 | 1 | V2 + (V1–V2) × 11/21 |
| 32 | 1 | 0 | 0 | 0 | 0 | 0 | V2 + (V1–V2) × 10/21 |
| 33 | 1 | 0 | 0 | 0 | 0 | 1 | V2 + (V1–V2) × 9/21 |
| 34 | 1 | 0 | 0 | 0 | 1 | 0 | V2 + (V1–V2) × 8/21 |
| 35 | 1 | 0 | 0 | 0 | 1 | 1 | V2 + (V1–V2) × 7/21 |
| 36 | 1 | 0 | 0 | 1 | 0 | 0 | V2 + (V1–V2) × 6/21 |
| 37 | 1 | 0 | 0 | 1 | 0 | 1 | V2 + (V1–V2) × 5/21 |
| 38 | 1 | 0 | 0 | 1 | 1 | 0 | V2 + (V1–V2) × 4/21 |
| 39 | 1 | 0 | 0 | 1 | 1 | 1 | V2 + (V1–V2) × 3/21 |
| 40 | 1 | 0 | 1 | 0 | 0 | 0 | V2 + (V1–V2) × 2/21 |
| 41 | 1 | 0 | 1 | 0 | 0 | 1 | V2 + (V1–V2) × 1/21 |
| 42 | 1 | 0 | 1 | 0 | 1 | 0 | V2 |
| 43 | 1 | 0 | 1 | 0 | 1 | 1 | V3 + (V2–V3) × 20/21 |
| 44 | 1 | 0 | 1 | 1 | 0 | 0 | V3 + (V2–V3) × 19/21 |
| 45 | 1 | 0 | 1 | 1 | 0 | 1 | V3 + (V2–V3) × 18/21 |
| 46 | 1 | 0 | 1 | 1 | 1 | 0 | V3 + (V2–V3) × 17/21 |
| 47 | 1 | 0 | 1 | 1 | 1 | 1 | V3 + (V2–V3) × 16/21 |
| 48 | 1 | 1 | 0 | 0 | 0 | 0 | V3 + (V2–V3) × 15/21 |
| 49 | 1 | 1 | 0 | 0 | 0 | 1 | V3 + (V2–V3) × 14/21 |
| 50 | 1 | 1 | 0 | 0 | 1 | 0 | V3 + (V2–V3) × 13/21 |
| 51 | 1 | 1 | 0 | 0 | 1 | 1 | V3 + (V2–V3) × 12/21 |
| 52 | 1 | 1 | 0 | 1 | 0 | 0 | V3 + (V2–V3) × 11/21 |

TABLE 1-continued

| TONE | INPUT | | | | | | OUTPUT |
|---|---|---|---|---|---|---|---|
| DATA | R5 | R4 | R3 | R2 | R1 | R0 | SIGNAL LINE DRIVE SIGNAL |
| 53 | 1 | 1 | 0 | 1 | 0 | 1 | V3 + (V2–V3) × 10/21 |
| 54 | 1 | 1 | 0 | 1 | 1 | 0 | V3 + (V2–V3) × 9/21 |
| 55 | 1 | 1 | 0 | 1 | 1 | 1 | V3 + (V2–V3) × 8/21 |
| 56 | 1 | 1 | 1 | 0 | 0 | 0 | V3 + (V2–V3) × 7/21 |
| 57 | 1 | 1 | 1 | 0 | 0 | 1 | V3 + (V2–V3) × 6/21 |
| 58 | 1 | 1 | 1 | 0 | 1 | 0 | V3 + (V2–V3) × 5/21 |
| 59 | 1 | 1 | 1 | 0 | 1 | 1 | V3 + (V2–V3) × 4/21 |
| 60 | 1 | 1 | 1 | 1 | 0 | 0 | V3 + (V2–V3) × 3/21 |
| 61 | 1 | 1 | 1 | 1 | 0 | 1 | V3 + (V2–V3) × 2/21 |
| 62 | 1 | 1 | 1 | 1 | 1 | 0 | V3 + (V2–V3) × 1/21 |
| 63 | 1 | 1 | 1 | 1 | 1 | 1 | V3 |

Table 2 shows a decoder-table-based conversion carried out by the decoder circuit 33 when the image signal carries 4 bits to effect, for example, a 16 tone graphics display (hereinafter, will be referred to 4 bit mode). Table 2, when compared to Table 1, shows the switching between conversion schema by means of decoder tables so that the conversion matches the number of tones represented by the image signals. In 4 bit mode, the same number of bus lines (i.e., six bus lines) for input image signals are required as in 6 bit mode, and the last 2 bits of the image signals, that is, the signals transmitted by the bus lines for the last 2 bits of the image signals, are fixed to either 0s or 1s. The table shows the 2 bits being fixed to 0s, as an example. Tones are represented by the first 4 bits.

Changing those signals transmitted by the bus lines for the bits representing tones or tone changes (the first 4 bits in the case here) and fixing those signals transmitted by the bus lines for the remaining bits (the last 2 bits in the case) to 0s as detailed above prevents the coupling of the foregoing bus lines (the bus lines for the last 2 bits in the case) and hence the occurrence of charging/discharging stray capacitance between the bus lines. Unnecessary power consumption is thus reduced.

Supposing that a 16 tone (4 bit) display be effected with the decoder table shown in Table 1, the last 2 bits would also change and charging/discharging stray capacitance would develop among all the bus lines. This tells that simply reducing the number of tones does not produce sufficient power-saving effects.

The decoder circuit 33 switches between decoder tables in line with the number of tones as detailed in the foregoing and achieves better power-saving effects.

TABLE 2

| TONE | INPUT | | | | | | OUTPUT |
|---|---|---|---|---|---|---|---|
| DATA | R5 | R4 | R3 | R2 | R1 | R0 | SIGNAL LINE DRIVE SIGNAL |
| 0 | 0 | 0 | 0 | 0 | 0 | 0 | V0 |
| 1 | 0 | 0 | 0 | 1 | 0 | 0 | V1 + (V0–V1) × 17/21 |
| 2 | 0 | 0 | 1 | 0 | 0 | 0 | V1 + (V0–V1) × 13/21 |
| 3 | 0 | 0 | 1 | 1 | 0 | 0 | V1 + (V0–V1) × 9/21 |
| 4 | 0 | 1 | 0 | 0 | 0 | 0 | V1 + (V0–V1) × 5/21 |
| 5 | 0 | 1 | 0 | 1 | 0 | 0 | V1 + (V0–V1) × 1/21 |
| 6 | 0 | 1 | 1 | 0 | 0 | 0 | V2 + (V1–V2) × 18/21 |
| 7 | 0 | 1 | 1 | 1 | 0 | 0 | V2 + (V1–V2) × 14/21 |
| 8 | 1 | 0 | 0 | 0 | 0 | 0 | V2 + (V1–V2) × 10/21 |
| 9 | 1 | 0 | 0 | 1 | 0 | 0 | V2 + (V1–V2) × 6/21 |
| 10 | 1 | 0 | 1 | 0 | 0 | 0 | V2 + (V1–V2) × 2/21 |
| 11 | 1 | 0 | 1 | 1 | 0 | 0 | V3 + (V2–V3) × 19/21 |
| 12 | 1 | 1 | 0 | 0 | 0 | 0 | V3 + (V2–V3) × 15/21 |
| 13 | 1 | 1 | 0 | 1 | 0 | 0 | V3 + (V2–V3) × 11/21 |

TABLE 2-continued

| TONE | INPUT | | | | | | OUTPUT |
|---|---|---|---|---|---|---|---|
| DATA | R5 | R4 | R3 | R2 | R1 | R0 | SIGNAL LINE DRIVE SIGNAL |
| 14 | 1 | 1 | 1 | 0 | 0 | 0 | V3 + (V2–V3) × 7/21 |
| 16 | 1 | 1 | 1 | 1 | 0 | 0 | V3 |

Table 3 shows another decoder-table-based conversion when the image signal is 1 bit to effect, for example, a 2 tone text display (hereinafter, will be referred to 1 bit mode). Table 3, when compared to Tables 1 and 2, again shows the switching between conversion schema by means of decoder tables so that the conversion matches the number of tones represented by the image signals. In 1 bit mode, the same number of bus lines (i.e., six bus lines) for input image signals are required as in 6 bit mode, and the last 5 bits of the image signals, that is, the signals transmitted by the bus lines for the last 5 bits of the image signals, are fixed to either 0s or 1s. The table shows the 5 bits being fixed to 0s, as an example. Tones are represented by the first bit.

Changing those signals transmitted by the bus lines for the bits representing tones or tone changes (the first bit in the case here) and fixing those signals transmitted by the bus lines for the remaining bits (the last 5 bits in the case) to 0s as detailed above prevents the coupling of the foregoing bus lines (the bus lines for the last 5 bits in the case) and hence the occurrence of charging/discharging stray capacitance between the bus lines. Unnecessary power consumption is thus reduced.

TABLE 3

| TONE | INPUT | | | | | | OUTPUT |
|---|---|---|---|---|---|---|---|
| DATA | R5 | R4 | R3 | R2 | R1 | R0 | SIGNAL LINE DRIVE SIGNAL |
| 0 | 0 | 0 | 0 | 0 | 0 | 0 | V0 |
| 1 | 1 | 0 | 0 | 0 | 0 | 0 | V3 |

As detailed in the foregoing, the signal line drive circuit 11 of the present embodiment produces large power saving effects by the decoder circuit 33 performing variable decoding. The decoder-table-based conversion may be implemented by either software loaded into memory or hardware as a part of the decoder circuit if certain specifications are determined. In the present embodiment, the largest number of tones are 6 as represented by R0–R5, as an example. This is not, however, the only possibility; the number of tones may be as many as 8 or 4 depending on specifications. The number of decoder tables is not limited to 3 as in the example and may be more or less than that. A separate decoder table may be provided for each of the red, green, and blue signals to effect fine tones.

The third control signal CS3 is supposed to be controlled in line with the number of tones represented by the input image signals to the signal line drive circuit 11, but is not necessarily so. For example, if the user gives priority to power saving and needs nothing more than a rough, barely recognizable image, the signal line drive circuit 11 receiving 4 bits incoming image signals (representing 16 tones) can still be forced to produce a 2 tone display by switching the decoder table to the conversion scheme in Table 3. The power saving effects, although not as great, but are still notable. This is useful, for example, to display an image containing a lot of letters and characters. This drive method achieves power saving and provides a display with desired recognizability.

The control signals CS1–CS3 to switch the decoder table between conversion schema are supplied by the setup circuit 14 to which a couple of setup signals MO are fed. The setup signals MO function to set the signal line drive circuit 11 to various power-saving drive modes as required. The setup signals MO may be fed in either parallel or serial; the latter case would require less setup signal lines.

The setup circuit 14 is typically composed of ordinary logic and other circuits and fed logic setup signals MO that are also logic signals. The internal arrangement of the setup circuit 14 is an issue that needs to be addressed in the design of the signal line drive circuit 11 in consideration of required levels of power saving; it is preferable if at least means is provided to latch the incoming setup signals MO. By latching the setup signals MO in, for example, a vertical blanking period, a temporary abnormal display can be prevented. The setup circuit 14 may be built in as part of the signal line drive circuit 11 or external to the signal line drive circuit 11.

[Embodiment 2]

The following will describe, as another embodiment in accordance with the present invention, applications of the signal line drive circuit 11 of embodiment 1 to an image display device, etc.

FIG. 2 is a block diagram showing an arrangement of a liquid crystal display 1 as an image display device in accordance with the present embodiment. The signal line drive circuit 11 here has the same internal arrangement as that of embodiment 1. The liquid crystal display 1 includes a setup circuit 14 that allows arbitrary selection of one of drive modes that dictate the power saving level of the signal line drive circuit 11, as partly described in embodiment 1. The setup circuit 14 outputs the first, second, and third control signal CS1, CS2, and CS3. The setup circuit 14 and the signal line drive circuit 11, although depicted as two separate components in FIG. 2, may be integrated in a single circuit. In this arrangement, as described earlier in embodiment 1, the signal line drive circuit 11 can be set to a drive mode independently to the number of tones represented by image signals and therefore readily switch between drive modes. The settings of the setup circuit 14 may be linked the number of tones represented by the image signals where necessary.

In the variable decoding by the decoder circuit 33, the lower bits of the image signals, that is, the signals transmitted by the bus lines for the lower bits of the image signals, are fixed to either 0s on the basis of the output signals (image signals) from the image signal supply circuit 3 in FIG. 2. This eliminates charging/discharging of stray capacitance between bus lines linking the image signal supply circuit 3, the signal line drive circuit 11, etc. and thus reduces unnecessary power consumption.

Power consumption in the signal line drive circuit 11 did not matter much in active matrix liquid crystal displays, since most of them were transmissive and their backlights consumed a lot of power. In contrast, recently, reflective or reflective/transmissive active matrix liquid crystal displays with superb color reproducibility have been developed and applied in portable apparatuses in increasing numbers. These displays either include no power-consuming backlight at all or use a backlight only for supplementary purposes, causing the power consumption in the signal line drive circuit 11 to account for a significant proportion of the total power consumption in the image display device. The reflective or reflective/transmissive image display device therefore enjoys large power-saving effects by the incorporation of the signal line drive circuit 11 of the present embodiment and offers easy selectability for power-saving drive modes to the user.

In the description in the foregoing, the active matrix liquid crystal display was taken as an example. The signal line drive circuit 11 of the present embodiment and the image display device incorporating it is applicable to simple matrix liquid crystal, electroluminescence, plasma, and other general electronic displays.

The following will describe applications of the image display device of the present embodiment to portable apparatuses.

The portable apparatuses operate on batteries and other portable power sources, and demand is high to reduce power consumption in the image display devices used as displays in those apparatuses. Using the image display device incorporating the signal line drive circuit 11 of the present embodiment as the display of the portable apparatus reduces the total power consumption of the portable apparatus and allows selection of power-saving levels of the image display device in line with the operating conditions of the apparatus. Hence, the portable apparatus overall consumes less of the power supplied by the batteries and runs for an extended period of time without recharging the batteries.

In this manner, the arrangement detailed in the present embodiment has wide range of applications where power saving feature is essential: for example, portable telephones, portable terminals, personal digital assistants, portable game machines, portable television sets, remote controllers, notebook computers, portable displays, and other portable apparatuses.

As detailed in the foregoing, a signal line drive circuit in accordance with the present invention is provided with a reference voltage chooser circuit for choosing, in accordance with tones represented by an image signal, a voltage derived from first reference voltages supplied to the signal line drive circuit to output a signal line drive signal, wherein:

a second reference voltage produced by voltage division from at least two of the first reference voltages is supplied to the reference voltage chooser circuit via a buffer circuit having a high input impedance and a low output impedance; and the first reference voltages are directly supplied to the reference voltage chooser circuit in which a voltage is chosen from input voltages and then output as a signal line drive signal in accordance with the tones represented by the image signal.

In the arrangement, some of the first reference voltages are directly supplied to the reference voltage chooser circuit and no buffer circuit is required for the reference voltage lines transmitting those directly supplied first reference voltages. As a result, the signal line drive circuit is smaller in area and can save on power by the amount equivalent to the eliminated current which in a conventional arrangement will occur in the buffer circuit.

Another signal line drive circuit in accordance with the present invention is provided with a reference voltage chooser circuit for choosing, in accordance with tones represented by an image signal, a voltage derived from first reference voltages supplied to the signal line drive circuit to output a signal line drive signal, wherein:

a second reference voltage produced by voltage division from at least two of the first reference voltages is supplied to the reference voltage chooser circuit via a buffer circuit having a high input impedance and a low output impedance;

among power supply voltages supplied to the signal line drive circuit, at least a power supply voltage supplied to the buffer circuit is supplied to the buffer circuit via a first switch controlled through a first control signal; and the reference voltage chooser circuit chooses one of incoming voltages to output a signal line drive signal in accordance with the tones represented by the image signal.

According to the arrangement, a first switch controlled through a first control signal is interposed between a power supply and a power supply terminal of the buffer circuit; when the reference voltage that appears at the output of the buffer circuit is not used, the power supply to the buffer circuit is cut off. Hence, the signal line drive circuit can save on power by the amount equivalent to the eliminated current which in a conventional arrangement will occur in parts of the signal line drive circuit.

Those parts where no current is necessary include not only constant current sources, such as an OP-amplifier constituting part of the buffer circuit, but also bias circuits in a case where the constant current source is not provided in the OP-amplifiers, but is arranged from a single circuit (hereinafter, will be referred to as a bias circuit) that is commonly shared by all the buffer circuits.

In the signal line drive circuit, the first switch may be controlled in accordance with the number of tones represented by the image signal.

In the arrangement, the first switch is controlled in accordance with the number of tones represented by the image signal. This allows arbitrary selection of a level of power saving in the signal line drive circuit in line with operating conditions.

Another signal line drive circuit in accordance with the present invention is provided with a voltage divider circuit for producing a second reference voltage by voltage division from at least two of first reference voltages supplied to the signal line drive circuit, the signal line drive circuit outputting a signal line drive signal in accordance with tones represented by an image signal, wherein a second switch controlled through a second control signal is interposed between the first reference voltages and the voltage divider circuit.

In the arrangement, a second switch controlled through a second control signal is interposed between the voltage divider circuit and the first reference power source supplying to the voltage divider circuit producing the second reference voltage; when the second reference voltage produced by the voltage divider circuit is not used, the first reference voltages supplied to the voltage divider circuit are cut off. Hence, the signal line drive circuit can save on power by the amount equivalent to the eliminated current which in a conventional arrangement will occur in the voltage divider circuit.

In the signal line drive circuit, the second switch may be controlled in accordance with the number of tones represented by the image signal.

In the arrangement, the second switch is controlled in accordance with the number of tones represented by the image signal. This allows arbitrary selection of a level of power saving in the signal line drive circuit in line with operating conditions.

Another signal line drive circuit in accordance with the present invention includes:

a sampling circuit for sampling an image signal;

a reference voltage chooser circuit for choosing a reference voltage in accordance with the sampled signal to output a signal line drive signal; and a decoder circuit for controlling the reference voltage chooser circuit in accordance with the sampled signal, wherein:

the decoder circuit is controlled through a third control signal to change a decoder table; and the reference voltage chooser circuit changes a reference voltage choosing pattern.

In the arrangement, a decoder circuit is provided which can change a decoder table in response to a third control signal; if the image signal carries unnecessary bits, the associated, therefore unnecessary, part of the data bus can be fixed to a certain potential. Hence, when the image signal represents a relatively small number of tones, the signal line drive circuit can save on power by the amount equivalent to the eliminated current which in a conventional arrangement will occur in that part of the data bus due to the propagation and accompanying changes of a signal in that part.

If the output of, for example, the image signal supply circuit supplying the image signal to the signal line drive circuit contains unnecessary bits, the associated, therefore unnecessary, transmission lines can be fixed to a certain potential. This prevents the coupling of the bus lines, for example, those between the signal line drive circuit and the image signal supply circuit, and hence the occurrence of charging/discharging stray capacitance between the bus lines. Unnecessary power consumption is thus reduced.

The signal line drive circuit may be adapted so that the decoder circuit is controlled in accordance with the number of tones represented by the image signal.

In the arrangement, the decoder circuit is controlled in accordance with the number of tones represented by the image signal. This allows arbitrary selection of a level of power saving in the signal line drive circuit in line with operating conditions.

Another signal line drive circuit in accordance with the present invention includes:

a sampling circuit for sampling an image signal;

a voltage divider circuit for producing a second reference voltage by voltage division from at least two of first reference voltages supplied to the signal line drive circuit; and a reference voltage chooser circuit for choosing a voltage derived from the first reference voltages to output a signal line drive signal, the second reference voltage being supplied to the reference voltage chooser circuit via a buffer circuit having a high input impedance and a low output impedance, the reference voltage chooser circuit choosing one of incoming voltages, the signal line drive circuit including a decoder circuit for controlling the reference voltage chooser circuit in accordance with the sampled signal and outputting the signal line drive signal in accordance with tones represented by the sampled signal, the signal line drive circuit being provided with at least any one of:

(i) a first switch to cut off power supply to the buffer circuit;

(ii) a second switch interposed between the first reference voltages and the voltage divider circuit to cut off the reference voltage supplied to the voltage divider circuit; and (iii) a decoder circuit for changing a decoder table to change a pattern according to which the reference voltage chooser circuit chooses a reference voltage;

wherein at least any one of the first switch, the second switch, and the decoder table for the decoder circuit is/are controlled for closure/opening or changed in accordance with the number of tones represented by the image signal.

In the arrangement, the signal line drive circuit is provided with at least any one of (i) a first switch controlled through a first control signal between a power supply and a power supply terminal of the buffer circuit, (ii) a second switch controlled through a second control signal between a voltage divider circuit and a first reference power source supplying to the voltage divider circuit producing a second reference voltage, and (iii) a decoder circuit controlling the tone reference voltage chooser circuit and having a decoder table controllable through a third control signal; and at least one of the first switch, the second switch, and the decoder circuit are controlled in accordance with the number of tones represented by the image signal. The signal line drive circuit can thus save on power.

The power saving effects are particularly remarkable with a signal line drive circuit provided with all of the first switch, the second switch, and the decoder circuit and adapted to control the first switch, the second switch, and the decoder circuit in accordance with the number of tones represented by the image signal.

Another signal line drive circuit in accordance with the present invention includes:

a sampling circuit for sampling an image signal;

a voltage divider circuit for producing a second reference voltage by voltage division from at least two of first reference voltages supplied to the signal line drive circuit; and a reference voltage chooser circuit for choosing a voltage derived from the first reference voltages to output a signal line drive signal, the second reference voltage being supplied to the reference voltage chooser circuit via a buffer circuit having a high input impedance and a low output impedance, the reference voltage chooser circuit choosing one of incoming voltages, the signal line drive circuit including a decoder circuit for controlling the reference voltage chooser circuit in accordance with the sampled signal and outputting the signal line drive signal in accordance with tones represented by the sampled signal, the signal line drive circuit being provided with:

a first switch to cut off power supply to the buffer circuit;

a second switch interposed between the first reference voltages and the voltage divider circuit to cut off the reference voltage supplied to the voltage divider circuit; and a decoder circuit for changing a decoder table to change a pattern according to which the reference voltage chooser circuit chooses a reference voltage;

wherein if the number of tones represented by the image signal is less than or equal to the number of the first reference voltages, the first switch and the second switch are both opened, and the decoder circuit switches the decoder table to one of the decoder tables that matches the number of tones represented by the image signal.

In the arrangement, the signal line drive circuit is provided with (i) a first switch controlled through a first control signal between a power supply and a power supply terminal of the buffer circuit, (ii) a second switch controlled through a second control signal between a voltage divider circuit and a first reference power source supplying to the voltage divider circuit producing a second reference voltage, and (iii) a decoder circuit controlling the tone reference voltage chooser circuit and having a decoder table controllable through a third control signal; the first switch, the second switch, or the decoder circuit is controlled in accordance with the number of tones represented by the image signal; and if the number of tones represented by the image signal is less than or equal to the number of the first reference voltages, the first switch and the second switch are both opened, and the decoder circuit switches the decoder table to one of the decoder tables that is applicable only to those bits corresponding to the image signal for which the decoder circuit is effective. This allows arbitrary selection of a level of power saving in the signal line drive circuit in line with operating conditions. The signal line drive circuit thus saves a lot on power, particularly when compared with a case when the number of tones represented by the image signal is more than the number of the first reference voltages.

An image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit for supplying signal line drive signals to the signal lines, the signal line drive circuit including a reference voltage chooser circuit for choosing, in accordance with tones represented by an image signal, a voltage derived from incoming first reference voltages to output the chosen voltage, wherein:

a second reference voltage produced by voltage division from at least two of the first reference voltages is supplied to the reference voltage chooser circuit via a buffer circuit having a high input impedance and a low output impedance;

among power source voltages supplied to the signal line drive circuit, at least a power source voltage supplied to the buffer circuit is supplied to the buffer circuit via a first switch controlled through a first control signal; and the reference voltage chooser circuit chooses one of incoming voltages to output the signal line drive signal in accordance with the tones represented by the image signal.

According to the arrangement, a first switch controlled through a first control signal is interposed between a power supply and a power supply terminal of the buffer circuit; when the reference voltage that appears at the output of the buffer circuit is not used, the power supply to the buffer circuit is cut off. Thus, the signal line drive circuit and hence the image display device incorporating the signal line drive circuit can save on power by the amount equivalent to the eliminated current which in a conventional arrangement will occur in parts of the signal line drive circuit.

Those parts where no current is necessary include not only constant current sources, such as an OP-amplifier constituting part of the buffer circuit, but also bias circuits in a case where the constant current source is not provided in the OP-amplifiers, but is arranged from a single circuit (hereinafter, will be referred to as a bias circuit) that is commonly shared by all the buffer circuits.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit for supplying signal line drive signals to the signal lines, the signal line drive circuit including: a voltage divider circuit for producing a second reference voltage by voltage division from at least two of incoming first reference voltages; and a reference voltage chooser circuit for choosing an output in accordance with tones represented by an image signal, wherein a second switch controlled through a second control signal is interposed between the first reference voltages and the voltage divider circuit.

In the arrangement, a second switch controlled through a second control signal is provided between a voltage divider circuit and a first reference power source supplying to a voltage divider circuit producing a second reference voltage; when the second reference voltage produced by the voltage divider circuit is not used, the first reference voltages supplied to the voltage divider circuit are cut off. Thus, the signal line drive circuit and hence the image display device incorporating the signal line drive circuit can save on power by the amount equivalent to the eliminated current which in a conventional arrangement will occur in the voltage divider circuit.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit including: a sampling circuit for sampling an image signal; a reference voltage chooser circuit for choosing an output in accordance with tones represented by an image signal; and a decoder circuit for controlling the reference voltage chooser circuit in accordance with the sampled signal, the reference voltage chooser circuit supplying signal line drive signals to the signal lines, wherein:

the decoder circuit is controlled through a third control signal to change a decoder table; and the reference voltage chooser circuit changes a reference voltage choosing pattern.

In the arrangement, a decoder circuit is provided of which the decoder table is controllable through a third control signal; if the image signal carries unnecessary bits, the associated, therefore unnecessary, part of the data bus can be fixed to a certain potential. Thus, when the image signal represents a relatively small number of tones, the signal line drive circuit and hence the liquid crystal display can save on power by the amount equivalent to the eliminated current which in a conventional arrangement will occur in that part of the data bus due to the propagation and accompanying changes of a signal in that part.

If the output of, for example, the image signal supply circuit supplying the image signal to the signal line drive circuit contains unnecessary bits, the associated, therefore unnecessary, transmission lines can be fixed to a certain potential. This prevents the coupling of the bus lines, for example, those between the signal line drive circuit and the image signal supply circuit, and hence the occurrence of charging/discharging stray capacitance between the bus lines. Unnecessary power consumption is thus reduced.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit including: a voltage divider circuit for producing a second reference voltage by voltage division from at least two of incoming first reference voltages; a reference voltage chooser circuit for choosing a voltage in accordance with tones represented by an image signal to output the chosen voltage; a sampling circuit for sampling the image signal; and a decoder circuit for controlling the reference voltage chooser circuit in accordance with the sampled signal, the second reference voltage being supplied to the reference voltage chooser circuit via a buffer circuit having a high input impedance and a low output impedance, the reference voltage chooser circuit choosing one of incoming voltages, the signal line drive circuit supplying signal line drive signals to the signal lines in accordance with tones represented by the image signal sampled by the sampling circuit, the signal line drive circuit being provided with at least any one of:

(i) a first switch to cut off power supply to the buffer circuit;

(ii) a second switch interposed between the first reference voltages and the voltage divider circuit to cut off the reference voltage supplied to the voltage divider circuit; and (iii) a decoder circuit for changing a decoder table to change a pattern according to which the reference voltage chooser circuit chooses a reference voltage;

wherein at least any one of the first switch, the second switch, and the decoder table for the decoder circuit is/are controlled for closure/opening or changed in accordance with the number of tones represented by the image signal.

In the arrangement, the signal line drive circuit is provided with at least any one of (i) a first switch controlled through a first control signal between a power supply and a power supply terminal of the buffer circuit, (ii) a second switch controlled through a second control signal between a voltage divider circuit and a first reference power source supplying to the voltage divider circuit producing a second reference voltage, and (iii) a decoder circuit controlling the tone reference voltage chooser circuit and having a decoder table controllable through a third control signal; and at least one of the first switch, the second switch, and the decoder circuit are controlled in accordance with the number of tones represented by the image signal. Thus, the signal line drive circuit and hence the image display device can save on power. The power saving effects are particularly remarkable with an image display device provided with all of the first switch, the second switch, and the decoder circuit and adapted to control the first switch, the second switch, and the decoder circuit in accordance with the number of tones represented by the image signal.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit including: a voltage divider circuit for producing a second reference voltage by voltage division from at least two of incoming first reference voltages; a reference voltage chooser circuit for choosing a voltage in accordance with tones represented by an image signal to output the chosen voltage; a sampling circuit for sampling the image signal; and a decoder circuit for controlling the reference voltage chooser circuit in accordance with the sampled signal, the second reference voltage being supplied to the reference voltage chooser circuit via a buffer circuit having a high input impedance and a low output impedance, the reference voltage chooser circuit choosing one of incoming voltages, the signal line drive circuit supplying signal line drive signals to the signal lines in accordance with tones represented by the image signal sampled by the sampling circuit, the image display device being provided with:

a first switch to cut off power supply to the buffer circuit;

a second switch interposed between the first reference voltages and the voltage divider circuit to cut off the reference voltage supplied to the voltage divider circuit; and a decoder circuit for changing a decoder table to change a pattern according to which the reference voltage chooser circuit chooses a reference voltage;

wherein if the number of tones represented by the image signal is less than or equal to the number of the first reference voltages, the first switch and the second switch are both opened, and the decoder circuit switches the decoder table to one of the decoder tables that matches the number of tones represented by the image signal.

In the arrangement, the image display device is provided with (i) a first switch controlled through a first control signal between a power supply and a power supply terminal of the buffer circuit, (ii) a second switch controlled through a second control signal between a voltage divider circuit and a first reference power source supplying to the voltage divider circuit producing a second reference voltage, and (iii) a decoder circuit controlling the tone reference voltage chooser circuit and having a decoder table controllable through a third control signal; the first switch, the second switch, or the decoder circuit is controlled in accordance with the number of tones represented by the image signal; and if the number of tones represented by the image signal is less than or equal to the number of the first reference voltages, the first switch and the second switch are both opened, and the decoder circuit switches the decoder table to one of the decoder tables that is applicable only to those bits corresponding to the image signal for which the decoder circuit is effective. This allows arbitrary selection of a level of power saving in the image display device in line with operating conditions. The image display device thus saves a lot on power, particularly when compared with a case when the number of tones represented by the image signal is more than the number of the first reference voltages.

The image display device may include a setup circuit for controlling at least any one of the first switch, the second switch, and the decoder circuit in accordance with a change in the number of tones represented by the image signal, so as to switch between drive mode arbitrarily.

In the arrangement, the image display device includes a setup circuit for controlling the first switch, the second switch, and/or the decoder circuit in the signal line drive circuit in accordance with the number of tones represented by the image signal and in line with operating conditions. Thus, the image display device can switch between drive modes arbitrarily and saves on power in line with operating conditions.

A portable apparatus in accordance with the present invention incorporates any one of the foregoing image display devices.

In the arrangement, the portable apparatus incorporates one of the foregoing image display devices. The portable apparatus can switch the image display device between drive modes depending on operating conditions and the type of the image signal and saves on power under various requirements, thereby capable of running on batteries for an extended period of time.

A signal line drive circuit in accordance with the present invention is provided with a reference voltage chooser circuit for choosing one of incoming voltages in accordance with tones represented by an image signal to output the chosen voltage as a signal line drive signal and includes a reference voltage line directly transmitting a first reference voltage supplied by external reference voltage supply means to the reference voltage chooser circuit.

In the arrangement, some of the first reference voltages are directly supplied to the reference voltage chooser circuit and no buffer circuit is required for the reference voltage lines transmitting those directly supplied first reference voltages. As a result, the signal line drive circuit is smaller in area and can save on power by the amount equivalent to the eliminated current which in a conventional arrangement will occur in the buffer circuit.

A signal line drive circuit in accordance with the present invention is provided with a reference voltage chooser circuit for choosing one of incoming voltages in accordance with tones represented by an image signal to output the chosen voltage as a signal line drive signal and includes:

a voltage divider circuit for producing a second reference voltage by voltage division from at least two first reference voltages supplied from external reference voltage supply means;

a buffer circuit, having a high input impedance and a low output impedance, for receiving the second reference voltage and supplying the second reference voltage to the reference voltage chooser circuit; and a reference voltage line directly transmitting the first reference voltages supplied from the reference voltage supply means to the reference voltage chooser circuit.

In the arrangement, some of the first reference voltages are directly supplied to the reference voltage chooser circuit and no buffer circuit is required for the reference voltage lines transmitting those directly supplied first reference voltages. As a result, the signal line drive circuit is smaller in area and can save on power by the amount equivalent to the eliminated current which in a conventional arrangement will occur in the buffer circuit.

Another signal line drive circuit in accordance with the present invention is provided with a reference voltage chooser circuit for choosing one of incoming voltages in accordance with tones represented by an image signal to output the chosen voltage as a signal line drive signal and includes:

a voltage divider circuit for producing a second reference voltage by voltage division from at least two first reference voltages supplied from external reference voltage supply means;

buffer circuits, each having a high input impedance and a low output impedance, for receiving the second reference voltage and supplying the second reference voltage to the reference voltage chooser circuit; and switches each provided to a different power supply line transmitting a power supply voltage to an associated buffer circuit so as to close/open the power supply line.

In the arrangement, each power supply line transmitting a power supply voltage to a buffer circuit is provided with a switch to close/open the power supply line; when the reference voltage that appears at the output of the buffer circuit is not used, the power supply to the buffer circuit is cut off. Thus, the signal line drive circuit can save on power by the amount equivalent to the eliminated current which in a conventional arrangement will occur in parts of the signal line drive circuit.

Those parts where no current is necessary include not only constant current sources, such as an OP-amplifier constituting part of the buffer circuit, but also bias circuits in a case where the constant current source is not provided in the OP-amplifiers, but is arranged from a single circuit (hereinafter, will be referred to as a bias circuit) that is commonly shared by all the buffer circuits.

The signal line drive circuit may be adapted so that the switches are controlled in accordance with the number of tones represented by the image signal.

In the arrangement, the switches are controlled in accordance with the number of tones represented by the image signal. This allows arbitrary selection of a level of power saving in the signal line drive circuit in line with operating conditions.

Another signal line drive circuit in accordance with the present invention is provided with a reference voltage chooser circuit for choosing one of incoming voltages in accordance with tones represented by an image signal to output the chosen voltage as a signal line drive signal and includes:

a voltage divider circuit for producing a second reference voltage by voltage division from at least two first reference voltages supplied from external reference voltage supply means; and a switch provided to a power supply line transmitting a first reference voltage to the voltage divider circuit so as to close/open the power supply line.

In the arrangement, a switch is provided power supply line transmitting a first reference voltage to the voltage divider circuit producing a second reference voltage so as to close/open the power supply line; when the second reference voltage produced by the voltage divider circuit is not used, the first reference voltages supplied to the voltage divider circuit are cut off. Thus, the signal line drive circuit can save on power by the amount equivalent to the eliminated current which in a conventional arrangement will occur in the voltage divider circuit.

In the signal line drive circuit, the switch may be controlled in accordance with the number of tones represented by the image signal.

In the arrangement, the switch is controlled in accordance with the number of tones represented by the image signal. This allows arbitrary selection of a level of power saving in the signal line drive circuit in line with operating conditions.

Another signal line drive circuit in accordance with the present invention includes:

a sampling circuit for sampling an image signal;

a decoder circuit for converting the signal sampled by the sampling circuit to a control signal, using one of decoder tables; and a reference voltage chooser circuit for choosing one of incoming voltages according to the control signal to output the chosen voltage as a signal line drive signal, wherein the decoder circuit switchably uses the decoder tables.

In the arrangement, the decoder circuit switchably uses the decoder tables; if the image signal carries unnecessary bits, the associated, therefore unnecessary, part of the data bus can be fixed to a certain potential. Thus, when the image signal represents a relatively small number of tones, the signal line drive circuit can save on power by the amount equivalent to the eliminated current which in a conventional arrangement will occur in that part of the data bus to transmit those bits.

If the output of, for example, the image signal supply circuit supplying the image signal to the signal line drive circuit contains unnecessary bits, the associated, therefore unnecessary, transmission lines can be fixed to a certain potential. This prevents the coupling of the bus lines, for example, those between the signal line drive circuit and the image signal supply circuit, and hence the occurrence of charging/discharging stray capacitance between the bus lines. Unnecessary power consumption is thus reduced further.

In the signal line drive circuit, the decoder tables may be adapted so that the conversion from the sampling signal to the control signal is such that the number of output voltages from the reference voltage chooser circuit differs from one decoder table to another.

In other words, the decoder tables may be adapted so that the reference voltage chooser circuit outputs voltages (signal line drive signals) according to a control signal obtained from the decoder table and the number (kinds) of the resultant output voltages differs from one decoder table to another.

In the arrangement, the decoder tables are switchably used where necessary. This ensures that no unnecessary signals are supplied to the data bus.

The signal line drive circuit may be adapted so that the switching between the decoder tables is controlled according to the number of tones represented by the image signal.

In the arrangement, the switching between the decoder tables is controlled according to the number of tones represented by the image signal. This allows arbitrary selection of a level of power saving in the signal line drive circuit in line with operating conditions.

Another signal line drive circuit in accordance with the present invention includes:

a sampling circuit for sampling an image signal;

a decoder circuit for converting the signal sampled by the sampling circuit to a control signal, using one of decoder tables; and a reference voltage chooser circuit for choosing one of incoming voltages according to the control signal to output the chosen voltage as a signal line drive signal, the signal line drive circuit outputting the signal line drive signal in accordance with tones represented by the sampled signal, wherein the signal line drive circuit includes:

a voltage divider circuit for producing a second reference voltage by voltage division from at least two first reference voltages supplied from external reference voltage supply means;

buffer circuits, each having a high input impedance and a low output impedance, for receiving the second reference voltage and supplying the second reference voltage to the reference voltage chooser circuit; and at least any one of (i) a first switch provided to a power supply line transmitting a power supply voltage to an associated buffer circuit so as to close/open the power supply line, (ii) a second switch provided to a power supply line transmitting the first reference voltages to the voltage divider circuit so as to close/open the power supply line, and (iii) an arrangement whereby the decoder circuit has decoder tables and switchably uses the decoder tables, wherein either (i) at least one of the first switch and the second switch is/are controlled for closure/opening in accordance with tones represented by an image signal or (ii) the decoder circuit switchably uses the decoder table suitable to tones represented by an image signal.

In the arrangement, the signal line drive circuit includes at least any one of (i) a first switch for closing/opening a power supply line transmitting a power supply voltage to an associated buffer circuit, (ii) a second switch for closing/opening a power supply line transmitting the first reference voltages to the voltage divider circuit, and (iii) an arrangement whereby the decoder circuit has decoder tables and switchably uses the decoder tables, and in accordance with tones represented by an image signal, either (i) at least one of the first switch and the second switch is/are controlled for closure/opening or (ii) the decoder circuit switchably uses the decoder table. The signal line drive circuit thus saves on power.

The power saving effects are particularly remarkable with a signal line drive circuit provided with all of the first switch, the second switch, and the decoder circuit and adapted to control the first switch, the second switch, and the decoder circuit in accordance with the number of tones represented by the image signal.

Another signal line drive circuit in accordance with the present invention includes:

a sampling circuit for sampling an image signal;

a decoder circuit for converting the signal sampled by the sampling circuit to a control signal, using one of decoder tables; and a reference voltage chooser circuit for choosing one of incoming voltages according to the control signal to output the chosen voltage as a signal line drive signal, the signal line drive circuit outputting the signal line drive signal in accordance with tones represented by the sampled signal, wherein the signal line drive circuit includes:

a voltage divider circuit for producing a second reference voltage by voltage division from at least two first reference voltages supplied from external reference voltage supply means;

buffer circuits, each having a high input impedance and a low output impedance, for receiving the second reference voltage and supplying the second reference voltage to the reference voltage chooser circuit;

a first switch provided to a power supply line transmitting a power supply voltage to an associated buffer circuit so as to close/open the power supply line;

a second switch provided to a power supply line transmitting the first reference voltages to the voltage divider circuit so as to close/open the power supply line; and an arrangement whereby the decoder circuit has decoder tables and switchably uses the decoder tables, wherein if the number of tones represented by the image signal is less than or equal to the number of the reference voltages supplied from the reference voltage supply means, the first switch and the second switch are both opened, and the decoder circuit switches the decoder table to one of the decoder tables that matches the number of tones represented by the image signal.

In the arrangement, the signal line drive circuit includes (i) a first switch for closing/opening a power supply line transmitting a power supply voltage to an associated buffer circuit, (ii) a second switch for closing/opening a power supply line transmitting the first reference voltages to the voltage divider circuit, and (iii) an arrangement whereby the decoder circuit has decoder tables and switchably uses the decoder tables; the first switch, the second switch, or the decoder circuit is controlled in accordance with the number of tones represented by the image signal; and if the number of tones represented by the image signal is less than or equal to the number of the reference voltages, the first switch and the second switch are both opened, and the decoder circuit switches the decoder table to one of the decoder tables that matches the number of tones represented by the image signal, that is, the decoder circuit switches the decoder table to one of the decoder tables that is applicable only to those bits corresponding to the image signal for which the decoder circuit is effective.

This allows arbitrary selection of a level of power saving in the signal line drive circuit in line with operating conditions. The signal line drive circuit thus saves a lot on power, particularly when compared with a case when the number of tones represented by the image signal is more than the number of the first reference voltages.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit provided with a reference voltage chooser circuit for choosing one of incoming voltages in accordance with tones represented by an image signal to output the chosen voltage to the signal line as a signal line drive signal, wherein the image display device further includes:

a voltage divider circuit for producing a second reference voltage by voltage division from at least two first reference voltages supplied from external reference voltage supply means;

buffer circuits, each having a high input impedance and a low output impedance, for receiving the second reference voltage and supplying the second reference voltage to the reference voltage chooser circuit; and a reference voltage line directly transmitting the first reference voltages supplied from the reference voltage supply means to the reference voltage chooser circuit.

In the arrangement, In the arrangement, some of the first reference voltages are directly supplied to the reference voltage chooser circuit and no buffer circuit is required for the reference voltage lines transmitting those directly supplied first reference voltages. As a result, the signal line drive circuit is smaller in area, and the image display device can save on power by the amount equivalent to the eliminated current which in a conventional arrangement will occur in the buffer circuit.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit provided with a reference voltage chooser circuit for choosing one of incoming voltages in accordance with tones represented by an image signal to output the chosen voltage to the signal line as a signal line drive signal, wherein the image display device further includes:

a voltage divider circuit for producing a second reference voltage by voltage division from at least two first reference voltages supplied from external reference voltage supply means;

buffer circuits, each having a high input impedance and a low output impedance, for receiving the second reference voltage and supplying the second reference voltage to the reference voltage chooser circuit;

switches each provided to a different power supply line transmitting a power supply voltage to an associated buffer circuit so as to close/open the power supply line; and control means for controlling the closure/opening of the switch.

In the arrangement, each power supply line transmitting a power supply voltage to a buffer circuit is provided with a switch to close/open the power supply line; when the reference voltage that appears at the output of the buffer circuit is not used, the power supply voltage to the buffer circuit is cut off. Thus, the signal line drive circuit and hence the image display device can save on power by the amount equivalent to the eliminated current which in a conventional arrangement will occur in parts of the signal line drive circuit.

Those parts where no current is necessary include not only constant current sources, such as an OP-amplifier constituting part of the buffer circuit, but also bias circuits in a case where the constant current source is not provided in the OP-amplifiers, but is arranged from a single circuit (hereinafter, will be referred to as a bias circuit) that is commonly shared by all the buffer circuits.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit provided with a reference voltage chooser circuit for choosing one of incoming voltages in accordance with tones represented by an image signal to output the chosen voltage to the signal line as a signal line drive signal, wherein the image display device further includes:

a voltage divider circuit for producing a second reference voltage by voltage division from at least two first reference voltages supplied from external reference voltage supply means;

switches each provided to a different power supply line transmitting a first reference voltage to the voltage divider circuit so as to close/open the power supply line; and control means for controlling the closure/opening of the switch.

In the arrangement, each power supply line transmitting a first reference voltage to the voltage divider circuit producing a second reference voltage is provided with a switch to close/open the power supply line; when the second reference voltage produced by the voltage divider circuit is not used, the first reference voltage transmitted to the voltage divider circuit is cut off. Thus, the signal line drive circuit and hence the image display device can save on power by the amount equivalent to the eliminated current which in a conventional arrangement will occur in the voltage divider circuit.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan; and a signal line drive circuit including: a sampling circuit for sampling an image signal; a decoder circuit for converting the signal sampled by the sampling circuit to a control signal, using one of decoder tables; and a reference voltage chooser circuit for choosing one of incoming voltages according to the control signal to output the chosen voltage as a signal line drive signal to one of the signal lines, wherein the decoder circuit has decoder tables and switchably uses the decoder tables and includes control means for switching between the decoder tables for use.

In the arrangement, the decoder circuit switchably uses the decoder tables; if the image signal carries unnecessary bits, the associated, therefore unnecessary, part of the data bus can be fixed to a certain potential. Thus, when the image signal represents a relatively small number of tones, the image display device can save on power by the amount equivalent to the eliminated current which in a conventional arrangement will occur in that part of the data bus to transmit those bits.

If the output of, for example, the image signal supply circuit supplying the image signal to the signal line drive circuit contains unnecessary bits, the associated, therefore unnecessary, transmission lines can be fixed to a certain potential. This prevents the coupling of the bus lines, for example, those between the signal line drive circuit and the image signal supply circuit, and hence the occurrence of charging/discharging stray capacitance between the bus lines. Unnecessary power consumption is thus reduced further.

In the image display device, the decoder tables may be adapted so that the conversion from the sampling signal to the control signal is such that the number of output voltages from the reference voltage chooser circuit differs from one decoder table to another.

In the arrangement, the decoder tables are switchably used where necessary. This ensures that no unnecessary signals are supplied to the data bus.

In the image display device, the control means may control the switching between the decoder tables according to the number of tones represented by the image signal.

In the arrangement, the control means controls the switching between the decoder tables according to the number of tones represented by the image signal. This allows arbitrary selection of a level of power saving in the image display device in line with operating conditions.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan;

a signal line drive circuit including: a sampling circuit for sampling an image signal; a decoder circuit for converting the signal sampled by the sampling circuit to a control signal, using one of decoder tables; and a reference voltage chooser circuit for choosing one of incoming voltages according to the control signal to output the chosen voltage as a signal line drive signal, the signal line drive circuit supplying the signal line drive signal to one of the signal lines in accordance with tones represented by the sampled signal, wherein the image display device further includes:

a voltage divider circuit for producing a second reference voltage by voltage division from at least two first reference voltages supplied from external reference voltage supply means;

buffer circuits, each having a high input impedance and a low output impedance, for receiving the second reference voltage and supplying the second reference voltage to the reference voltage chooser circuit;

at least any one of (i) a first switch provided to a power supply line transmitting a power supply voltage to an associated buffer circuit so as to close/open the power supply line, (ii) a second switch provided to a power supply line transmitting the first reference voltages to the voltage divider circuit so as to close/open the power supply line, and (iii) an arrangement whereby the decoder circuit has decoder tables and switchably uses the decoder tables; and control means for either (i) controlling at least one of the first switch and the second switch for closure/opening in accordance with tones represented by an image signal or (ii) switching between the decoder tables so that the decoder circuit uses one of the decoder tables that matches tones represented by an image signal.

In the arrangement, the image display device includes at least any one of (i) a first switch for closing/opening a power supply line transmitting a power supply voltage to an associated buffer circuit, (ii) a second switch for closing/opening a power supply line transmitting the first reference voltages to the voltage divider circuit, and (iii) an arrangement whereby the decoder circuit has decoder tables and switchably uses the decoder tables, and in accordance with tones represented by an image signal, either (i) at least one of the first switch and the second switch is/are controlled for closure/opening or (ii) the decoder circuit switchably uses the decoder table. The image display device thus saves on power.

The power saving effects are particularly remarkable with an image display device provided with all of the first switch, the second switch, and the decoder circuit and adapted to control the first switch, the second switch, and the decoder circuit in accordance with the number of tones represented by the image signal.

Another image display device in accordance with the present invention includes:

pixels arranged in a matrix form;

signal lines connected to the pixels;

scan lines connected to the pixels;

a scan signal line drive circuit for supplying scan signals to the scan lines for a vertical scan;

a signal line drive circuit including: a sampling circuit for sampling an image signal; a decoder circuit for converting the signal sampled by the sampling circuit to a control signal, using one of decoder tables; and a reference voltage chooser circuit for choosing one of incoming voltages according to the control signal to output the chosen voltage as a signal line drive signal, the signal line drive circuit outputting the signal line drive signal to one of the signal lines in accordance with tones represented by the sampled signal, wherein the image display device includes:

a voltage divider circuit for producing a second reference voltage by voltage division from at least two first reference voltages supplied from external reference voltage supply means;

buffer circuits, each having a high input impedance and a low output impedance, for receiving the second reference voltage and supplying the second reference voltage to the reference voltage chooser circuit;

a first switch provided to a power supply line transmitting a power supply voltage to an associated buffer circuit so as to close/open the power supply line;

a second switch provided to a power supply line transmitting the first reference voltages to the voltage divider circuit so as to close/open the power supply line;

an arrangement whereby the decoder circuit has decoder tables and switchably uses the decoder tables; and control means for, if the number of tones represented by the image signal is less than or equal to the number of the reference voltages supplied from the reference voltage supply means, opening both the first switch and the second switch and switching between the decoder tables so that the decoder circuit uses one of the decoder tables that matches tones represented by an image signal.

In the arrangement, the image display device includes (i) a first switch for closing/opening a power supply line transmitting a power supply voltage to an associated buffer circuit, (ii) a second switch for closing/opening a power supply line transmitting the first reference voltages to the voltage divider circuit, and (iii) an arrangement whereby the decoder circuit has decoder tables and switchably uses the decoder tables; the first switch, the second switch, or the decoder circuit is controlled in accordance with the number of tones represented by the image signal; and if the number of tones represented by the image signal is less than or equal to the number of the reference voltages, the first switch and the second switch are both opened, and the decoder circuit switches the decoder table to one of the decoder tables that matches the number of tones represented by the image signal, that is, the decoder circuit switches the decoder table to one of the decoder tables that is applicable only to those bits corresponding to the image signal for which the decoder circuit is effective.

This allows arbitrary selection of a level of power saving in the image display device in line with operating conditions. The image display device thus saves a lot on power, particularly when compared with a case when the number of tones represented by the image signal is more than the number of the first reference voltages.

A portable apparatus in accordance with the present invention incorporates any one of the foregoing image display device.

Thus, the portable apparatus can switch the image display device between drive modes depending on operating conditions and the type of the image signal and saves on power under various requirements, thereby capable of running on batteries for an extended period of time.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A signal line drive circuit provided with a reference voltage chooser circuit for choosing, in accordance with tones represented by an image signal, a voltage among multiple reference voltages supplied to the signal line drive circuit to output as a signal line drive signal, wherein:

a second reference voltage produced by voltage division utilizing a ladder resistor from at least two first reference voltages is supplied to the reference voltage chooser circuit via a buffer circuit having a high input impedance and a low output impedance;

the first reference voltages are simultaneously directly supplied to the reference voltage chooser circuit from external first reference voltage supply means, and switches controlled by a control signal are interposed between the ladder resistor and power supply lines for the respective first reference voltages.

2. A signal line drive circuit provided with a reference voltage chooser circuit for choosing, in accordance with tones represented by an image signal, a voltage among multiple voltages supplied to the reference voltage chooser circuit to output as a signal line drive signal, wherein:

multiple first reference voltages are supplied simultaneously and directly from external first reference voltage supply means to the reference voltage chooser circuit;

a second reference voltage produced by voltage division utilizing ladder resistor from at least two of the first reference voltages is supplied to the reference voltage chooser circuit via a buffer circuit having a high input impedance and a low output impedance when a buffer circuit power supply voltage is supplied to the buffer circuit via a first switch controlled by a first control signal;

second switches controlled by a second control signal are interposed between the ladder resistor and power supply lines for the respective first reference voltages, and the reference voltage chooser circuit chooses one of incoming voltages to output as a signal line drive signal in accordance with the tones represented by the image signal.

3. The signal line drive circuit as defined in claim 2, wherein the first switch is controlled in accordance with the number of tones represented by the image signal.

4. A signal line drive circuit, provided with a voltage chooser circuit and a voltage divider circuit including a ladder resistor for producing a second reference voltage by voltage division from at least two first reference voltages, the at least two first reference voltages being supplied simultaneously directly to the voltage chooser circuit from external first reference voltage supply means, and a buffer circuit for selectively providing the second reference voltage to the voltage chooser circuit in response to a first control signal, the signal line drive circuit outputting a signal line drive signal in accordance with tones represented by an image signal, wherein a second switch controlled by a second control signal is interposed between the first reference voltages and the voltage divider circuit ladder resistor, and third switches controlled by a third signal are interposed between the voltage divider circuit ladder resistor and power supply lines for the respective first reference voltages.

5. The signal line drive circuit as defined in claim 4, wherein the second switch is controlled in accordance with the number of tones represented by the image signal.

6. A signal line drive circuit, comprising:

a sampling circuit for sampling an image signal so as to generate a sampling signal representative of the number of tones contained in said image signal;

a reference voltage chooser circuit including a ladder resistor for choosing a reference voltage in accordance with the sampling signal to output a signal line drive signal from among multiple first reference voltages simultaneously directly supplied to the reference voltage chooser circuit from external first reference voltage supply means, and a second reference voltage produced by voltage division from at least two of the first reference voltages supplied to the reference voltage chooser circuit via a buffer circuit having a high input impedance and a low output impedance;

switches controlled by a control signal interposed between the resistor ladder and power supply lines for the respective first reference voltages, and a decoder circuit for controlling the reference voltage chooser circuit in accordance with the sampling signal;

wherein:

the decoder circuit is controlled by a third control signal in accordance with a decoder table indicative of the number of tones represented by the sampling signal; and the reference voltage chosen by the reference voltage chooser circuit changes in response to an output of the decoder circuit.

7. A signal line drive circuit including:

a sampling circuit for sampling an image signal;

a voltage divider circuit including a ladder resistor for producing a second reference voltage by voltage division from multiple first reference voltages from external voltage supply means supplied to the signal line drive circuit;

switches controlled by a control signal interposed between the ladder resistor and power supply lines for the respective first reference voltages, and a reference voltage chooser circuit for choosing one of said first or second reference voltages to output as a signal line drive signal, the first reference voltages being supplied simultaneously directly to the reference chooser circuit and the second reference voltage being supplied to the reference voltage chooser circuit via a buffer circuit having a high input impedance and a low output impedance, the signal line drive circuit including a decoder circuit for controlling the reference voltage chooser circuit in accordance with the sampled signal and outputting the signal line drive signal in accordance with tones represented by the sampled signal, said signal line drive circuit comprising at least any one of:

(i) a first switch to cut off power supply to the buffer circuit;

(ii) a second switch interposed between the first reference voltages and the voltage divider circuit to cut off the reference voltage supplied to the voltage divider circuit; and (iii) a control circuit for controlling said decoder circuit to change a decoder table so as to change the reference voltage chosen by the reference voltage chooser circuit in accordance with a number of tones represented by the image signal, wherein at least any one of the first switch, the second switch, and the control circuit is set in accordance with the number of tones represented by the image signal.

8. A signal line drive circuit including:

a sampling circuit for sampling an image signal;

a voltage divider circuit including a ladder resistor for producing a second reference voltage by voltage division from at least two first reference voltages supplied to the signal line drive circuit;

switches controlled by a control signal interposed between the ladder resistor and power supply lines for the respective first reference voltages, and a reference voltage chooser circuit for choosing one of said first or said second reference voltages to output as a signal line drive signal, the first reference voltages being supplied simultaneously directly to the voltage chooser circuit from external first reference voltage supply means and said second reference voltage being supplied to the reference voltage chooser circuit via a buffer circuit having a high input impedance and a low output impedance, the signal line drive circuit including a decoder circuit for controlling the reference voltage chooser circuit in accordance with the sampled signal and outputting the signal line drive signal in accordance with tones represented by the sampled signal, said signal line drive circuit comprising:

a first switch to cut off power supply to the buffer circuit;

a second switch interposed between the first reference voltages and the voltage divider circuit to cut off the reference voltage supplied to the voltage divider circuit; and a control circuit for controlling said decoder circuit to change a decoder table so as to change the reference voltage chosen by the reference voltage chooser circuit in accordance with a number of tones represented by the image signal, wherein when the number of tones represented by the image signal is less than or equal to the number of the first reference voltages, the first switch and the second switch are both opened, and the control circuit changes the decoder table to one of the decoder tables that matches the number of tones represented by the image signal.

9. An image display device, comprising:

pixels arranged in a matrix form;

signal lines connected to the pixels;

scan lines connected to the pixels;

a scan signal line drive circuit for supplying scan signals to the scan lines for a vertical scan; and a signal line drive circuit for supplying signal line drive signals to the signal lines, the signal line drive circuit including a reference voltage chooser circuit for choosing, in accordance with tones represented by an image signal, a first or a second reference voltage to output as the chosen voltage, wherein:

the second reference voltage is produced by voltage division utilizing a ladder resistor from at least two of the first reference voltages and is supplied to the reference voltage chooser circuit via a buffer circuit having a high input impedance and a low output impedance; and the first reference voltages carried by power supply lines are simultaneously directly supplied to the reference voltage chooser circuit from external first reference voltage supply means and the power supply lines for the respective first reference voltages are separated from the ladder resistor by switches controlled by a control signal.

10. A portable apparatus, comprising an image display device as defined in claim 9.

11. An image display device, comprising:

pixels arranged in a matrix form;

signal lines connected to the pixels;

scan lines connected to the pixels;

a scan signal line drive circuit for supplying scan signals to the scan lines for a vertical scan; and a signal line drive circuit for supplying signal line drive signals to the signal lines, the signal line drive circuit including a reference voltage chooser circuit for choosing, in accordance with tones represented by an image signal, a first or a second reference voltage to output as the chosen voltage, wherein:

the second reference voltage is produced by voltage division utilizing a ladder resistor from at least two of the first reference voltages and is supplied to the reference voltage chooser circuit via a buffer circuit having a high input impedance and a low output impedance;

the first reference voltages carried by power supply lines are supplied simultaneously directly to the voltage chooser circuit from an external first reference voltage source and the power supply lines for the respective first reference voltages are separated from the ladder resistor by switches controlled by a control signal; and a buffer circuit power supply voltage is supplied to the buffer circuit via a first switch controlled by a first control signal.

12. A portable apparatus, comprising an image display device as defined in claim 11.

13. An image display device, comprising:

pixels arranged in a matrix form;

signal lines connected to the pixels;

scan lines connected to the pixels;

a scan signal line drive circuit for supplying scan signals to the scan lines for a vertical scan; and a signal line drive circuit for supplying signal line drive signals to the signal lines, the signal line drive circuit including:

a reference voltage chooser circuit for choosing an output from among first and second reference voltages in accordance with tones represented by an image signal; a voltage divider circuit including a ladder resistor for producing said second reference voltage by voltage division from multiple first reference voltages simultaneously directly supplied to said voltage chooser circuit from external reference voltage supply means, wherein second switches controlled by a second control signal interposed between the first reference voltages and the ladder resistor of the voltage divider circuit.

14. A portable apparatus, comprising an image display device as defined in claim 13.

15. An image display device, comprising:

pixels arranged in a matrix form;

signal lines connected to the pixels;

scan lines connected to the pixels;

a scan signal line drive circuit for supplying scan signals to the scan lines for a vertical scan; and a signal line drive circuit including:

a sampling circuit for sampling an image signal so as to generate a sampling signal representative of the number of tones contained in the image signal;

a reference voltage chooser circuit including a ladder resistor for choosing an output in accordance with tones represented by the sampling signal from among first reference voltages simultaneously directly supplied to the reference voltage chooser circuit from external first reference voltage supply means and a second reference produced by voltage division from at least two of the first reference voltages supplied to the reference voltage chooser circuit via a buffer circuit having a high input impedance and a low output impedance;

switches controlled by a control signal interposed between the ladder resistor and power supply lines for the respective first reference voltages, and a decoder circuit for controlling the reference voltage chooser circuit in accordance with the sampling signal, the reference voltage chooser circuit supplying signal line drive signals to the signal lines, wherein:

the decoder circuit is controlled by a third control signal in accordance with a decoder table indicative of the number of tones represented by the sampling signal; and the reference voltage chooser circuit changes the chosen reference voltage in response to an output of the decoder circuit.

16. A portable apparatus, comprising an image display device as defined in claim 15.

17. An image display device, comprising:

pixels arranged in a matrix form;

signal lines connected to the pixels;

scan lines connected to the pixels;

a scan signal line drive circuit for supplying scan signals to the scan lines for a vertical scan; and a signal line drive circuit including:

a voltage divider circuit including a ladder resistor for producing a second reference voltage by voltage division from multiple first reference voltages supplied to the signal line drive circuit from external first reference voltage supply means;

a reference voltage chooser circuit for choosing among said first reference voltages supplied simultaneously directly thereto or a second reference voltage from said voltage divider circuit in accordance with tones represented by an image signal to output the chosen voltage;

a sampling circuit for sampling the image signal; and a decoder circuit for controlling the reference voltage chooser circuit in accordance with the sampled signal, the second reference voltage being supplied to the reference voltage chooser circuit via a buffer circuit having a high input impedance and a low output impedance, said signal line drive circuit comprising at least any one of:

(i) a first switch to cut off power supply to the buffer circuit;

(ii) second switches interposed between power supply lines for the respective first reference voltages and the ladder resistor of the voltage divider circuit to cut off the reference voltage supplied to the voltage divider circuit; and (iii) a control circuit for controlling said decoder circuit to change a decoder table so as to change the reference voltage chosen by the reference voltage chooser circuit in accordance with a number of tones represented by the image signal, wherein at least any one of the first switch, the second switch, and the control circuit is set in accordance with the number of tones represented by the image signal.

18. The image display device as defined in claim 17, wherein said control circuit comprises a setup circuit for controlling at least any one of the first switch, the second switch, and the voltage chooser circuit in accordance with a change in the number of tones represented by the image signal, so as to switch among drive modes of said image display device arbitrarily.

19. A portable apparatus, comprising an image display device as defined in claim 17.

20. An image display device including:

pixels arranged in a matrix form;

signal lines connected to the pixels;

scan lines connected to the pixels;

a scan signal line drive circuit for supplying scan signals to the scan lines for a vertical scan; and a signal line drive circuit including:

a voltage divider circuit including a ladder resistor for producing a second reference voltage by voltage division from at least two first reference voltages;

a reference voltage chooser circuit for choosing one of said first or second voltages in accordance with tones represented by an image signal to output as the chosen voltage;

a sampling circuit for sampling the image signal; and a decoder circuit for controlling the reference voltage chooser circuit in accordance with the sampled signal, the first reference voltages being supplied simulataneously directly to the voltage chooser circuit from external first reference voltage supply means and the second reference voltage being supplied to the reference voltage chooser circuit via a buffer circuit having a high input impedance and a low output impedance, the signal line drive circuit supplying signal line drive signals to the signal lines in accordance with tones represented by the image signal sampled by the sampling circuit, said image display device comprising:

a first switch to cut off power supply to the buffer circuit;

second switches interposed between power supply lines for the respective first reference voltages and the ladder resistor of voltage divider circuit to cut off the reference voltage supplied to the voltage divider circuit; and a control circuit for controlling said decoder circuit to change a decoder table so as to change the reference voltage chosen by the reference voltage chooser circuit in accordance with a number of tones represented by the image signal;

wherein when the number of tones represented by the image signal is less than or equal to the number of the first reference voltages, the first switch and the second switch are both opened, and the control circuit switches the decoder table to a decoder table that matches the number of tones represented by the image signal.

21. The image display device as defined in claim 20, wherein said control circuit comprises a setup circuit for controlling at least any one of the first switch, the second switch, and the voltage chooser circuit in accordance with a change in the number of tones represented by the image signal, so as to switch among drive modes of said image display device arbitrarily.

22. A portable apparatus, comprising an image display device as defined in claim 20.

* * * * *